US011889965B2

(12) United States Patent
Dirnberger et al.

(10) Patent No.: US 11,889,965 B2
(45) Date of Patent: Feb. 6, 2024

(54) DOMESTIC APPLIANCE WITH A LATCHING AND OPENING FUNCTION FOR A DOOR OF THE DOMESTIC APPLIANCE

(71) Applicant: emz-Hanauer GmbH & Co. KGaA, Nabburg (DE)

(72) Inventors: Albert Dirnberger, Neunburg vorm Wald (DE); Josef Bauriedl, Neunburg vorm Wald (DE); Matthias Bauer, Schmidgaden (DE); Georg Spießl, Altendorf (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 0 days.

(21) Appl. No.: 17/680,500

(22) Filed: Feb. 25, 2022

(65) Prior Publication Data

US 2022/0273157 A1 Sep. 1, 2022

(30) Foreign Application Priority Data

Feb. 26, 2021 (DE) ..... 102021104747.1

(51) Int. Cl.
*A47L 15/42* (2006.01)

(52) U.S. Cl.
CPC ..... *A47L 15/4259* (2013.01)

(58) Field of Classification Search
CPC ..... A47L 15/4259
See application file for complete search history.

(56) References Cited

U.S. PATENT DOCUMENTS

2016/0029872 A1* 2/2016 Kim ..... F16J 15/061 312/228

FOREIGN PATENT DOCUMENTS

| | | | | |
|---|---|---|---|---|
| CN | 107237561 A | * | 10/2017 | ..... A47L 15/18 |
| CN | 108661454 A | * | 10/2018 | ..... A47L 15/4259 |
| DE | 19837248 A1 | | 2/2000 | |
| DE | 102011011662 A1 | | 8/2012 | |
| DE | 102012016541 A1 | | 2/2014 | |
| DE | 102014218238 B3 | | 10/2015 | |
| EP | 2394559 A2 | | 12/2011 | |

OTHER PUBLICATIONS

Machine translation of CN-108661454-A, dated Oct. 2018. (Year: 2018).*

* cited by examiner

*Primary Examiner* — Michael E Barr
*Assistant Examiner* — Kevin G Lee
(74) *Attorney, Agent, or Firm* — Hayes Soloway PC

(57) ABSTRACT

A mechanism for the door of a domestic electrical appliance, for example a dishwasher, is described. The mechanism includes a door latch for holding the door closed, a latch opener mechanism, an electrically controlled actuator for displacing the latch opener mechanism, a movably arranged pusher, and a spring device for providing a spring force which acts on the pusher. The latch opener mechanism functions such that, when the door is closed, it can be transferred from an inactive position into an active position while at least partially overcoming a holding-closed action of the door latch. The movably arranged pusher is separate from the latch opener mechanism and is decoupled therefrom in terms of movement. After the holding-closed action of the door latch has been overcome, the spring drive allows the door to be pushed open by the pusher.

14 Claims, 12 Drawing Sheets

DOMESTIC APPLIANCE WITH A LATCHING AND OPENING FUNCTION FOR A DOOR OF THE DOMESTIC APPLIANCE

CROSS-REFERENCE TO RELATED APPLICATIONS

This application claims priority to German Patent Application 10 2021 104 747.1, filed on Feb. 26, 2021, the contents of which are incorporated by reference herein.

TECHNICAL FIELD

The invention relates generally to domestic electrical appliances which have a door for selectively closing and freeing access to a process chamber formed inside a main body of the domestic appliance. Specifically, the invention relates to those domestic appliances which are equipped with a door latch which allows the closed door to be held closed and which are designed with suitable means for overcoming the holding-closed action of the door latch and allowing the door to be opened at least slightly without the involvement of a user.

BACKGROUND

In washing machines and dishwashers for domestic use, there is a growing need for solutions to automatically open the door of the machine slightly on completion of a cleaning program in order that heat or/and moisture can escape from the interior of the machine. In dishwashers, this assists with the desired drying of the dishes, which are still wet at the end of the cleaning program, and allows the energy outlay required for actively drying the dishes to be reduced. Within the context of general efforts to lower the energy consumption of domestic electrical appliances, the drying phase at the end of a program run of a dishwasher has emerged as a source of possible relevant savings. However, adequate cooling and ventilation of the dishwashing chamber of the dishwasher can only be ensured if the door is opened by more than only a gap of a few millimeters. Generally, an opening gap of several centimeters is required at least in the region of the top edge of the door (assuming that the door—as is conventional in domestic dishwashers—is pivotably mounted in the region of its bottom edge on the dishwashing container of the dishwasher) in order to ensure an air exchange in a sufficient amount between the dishwashing chamber and the external environment.

Some conventional dishwashers have in the region of the door hinge, by means of which the door is mounted on the dishwashing container, one or more hinge springs which exert on the closed door a biasing force acting in the opening direction. The hinge springs are not strong enough to overcome, when the door is closed, the holding-closed action of the door latch, that is to say the action which the door latch opposes to an attempt at opening the closed door. However, if the holding-closed action is overcome in a different way (e.g. by manual intervention by the user or by means of a motor-driven pusher), the force of the hinge springs may be sufficient in such conventional dishwashers to open the door, driven by spring force, from a still largely vertical position, in which the transmission of force via the door latch is only just released, to such an extent that the air exchange required for air drying of the dishes is possible through the opening gap that has formed.

However, where dishwashers are not equipped with such hinge springs acting in the opening direction of the door, other solutions are required in order to allow the door to be opened by the required amount without the assistance of the user.

SUMMARY

An object of the invention is to show a way in which, in a domestic electrical appliance, and in particular in a domestic dishwasher, the door can automatically be opened by a sufficiently large amount without door-opening hinge springs being a necessary requirement therefor.

In order to achieve this object, the invention provides a mechanism for a door of a domestic electrical appliance, wherein the mechanism comprises: a door latch for holding the door closed; a latch opener mechanism which, when the door is closed, is configured to be transferred from an inactive position into an active position while at least partially overcoming a holding-closed action of the door latch; an electrically controllable actuator for displacing the latch opener mechanism from the inactive position into the active position; a movably, in particular linearly movably, arranged pusher, which is separate from the latch opener mechanism and is motionally decoupled therefrom, for force transmission, in the sense of opening of the door, in a force transmission path which bypasses the door latch; and a spring drive configured to provide a spring force which acts on the pusher and which, after the holding-closed action of the door latch has been overcome, permits the door to be pushed open by the pusher.

When the door is closed, the door latch provides a resistance against an attempt at opening the door. This resistance can be referred to as the holding-closed action of the door latch. For opening the door, this resistance must be overcome. At least under normal, regular operating conditions, the spring drive is not strong enough to overcome the holding-closed action of the door latch. In order nevertheless to be able to overcome the holding-closed action of the door latch automatically, the mechanism according to the invention comprises a latch opener mechanism with an associated electrically controlled actuator. The actuator and the latch opener mechanism provide at least part of the force which, starting from the closed door, is required to overcome the holding-closed action of the door latch. By operating the actuator when the door is closed, the door latch is thus brought into a state in which the resistance provided by the door latch to opening of the door is overcome at least partially. In some embodiments, the actuator and the latch opener mechanism are intended and adapted to overcome the holding-closed action of the door latch completely. After the holding-closed action of the door latch has been overcome, further force assistance by the actuator and the latch opener mechanism is no longer required. Instead, the force of the spring drive is sufficient to push the door open sufficiently wide after the holding-closed action of the door latch has been overcome.

The door latch comprises at least one component which is arranged on the door and which, on closing of the door, comes into closing engagement with at least one component arranged on a main body of the domestic appliance. A process chamber, for example a dishwashing chamber in the case of a dishwasher, is formed in the main body; the door is typically pivotably mounted on the main body and, when it is closed, closes an access opening to the process chamber. The latch opener mechanism, when it is transferred, with the door initially closed, from the inactive position into the active position, overcomes at least part of the resistance of the door latch which a user would have to overcome if he had to open the closed door without any other technical assistance. At least partially overcoming the resistance of the door latch can include, for example, a relative displacement of the components of the door latch that are in closing engagement contrary to a closing spring force. Alternatively or in addition, at least partially overcoming the resistance of the door latch can include, for example, a joint displacement of the components of the door latch that are in closing engagement contrary to a closing spring force.

In some embodiments, the door latch comprises a pair of latch arms which, when the door is closed, grip a latch head and thereby hold the door closed, as is shown and described, for example, in DE 10 2012 016 541 A1. In such embodiments, operation of the actuator starting from the inactive position of the latch opener mechanism can lead, for example, to the latch opener mechanism driving the latch arms apart contrary to a closing spring force. Alternatively or in addition, the latch opener mechanism can, for example, push the latch head out of the grip of the latch arms transversely to the pivot plane of the latch arms. In other embodiments, the door latch comprises a pair of latch arms which, when the door is closed, are caught in a closing mouth, as is shown and described, for example, in DE 10 2011 011 662 A1. In such embodiments, operation of the actuator starting from the inactive position of the latch opener mechanism can lead, for example, to the latch opener mechanism pushing the latch arms together contrary to a closing spring force, so that removal of the latch arms from the closing mouth is at least facilitated. In yet other embodiments, the latch opener mechanism can, for example, displace a rotary gripper, which forms a gripping mouth for capturing a stirrup web which enters the gripping mouth on closing of the door (as shown and described, for example, in DE 198 37 248 A1), in rotation or/and in translation contrary to the force of one or more closing springs of the door latch. In all these examples, the actuator-driven displacement of the latch opener mechanism from the inactive position into the active position causes the holding-closed action of the door latch to be overcome at least partially. The content of the mentioned DE specifications is hereby explicitly incorporated herein in its entirety.

The latch opener mechanism can be a single-membered or multi-membered mechanism. In some embodiments, the latch opener mechanism comprises a single, movably arranged latch opener component, which can be driven by the actuator along a straight or curved path and cooperates directly with a target component in a force-transmitting manner. Examples of such a single-component configuration of the latch opener mechanism are a linear slider and a lever. In other embodiments, the latch opener mechanism is formed by a structure of a plurality of components which are movable relative to one another, wherein this structure as a whole ensures force transmission from the actuator to one or more target components. An example of a multi-part latch opener mechanism is a bent lever mechanism.

The pusher is a mechanical component via which there runs a force transmission path which allows a force transmission, past the door latch, between the door and the main body of the domestic appliance in the sense of opening of the door. In the inactive position of the latch opener mechanism and with the door closed, this force transmission path running via the pusher can still be open, for example because the pusher is still at a distance from a pressure-receiving component with which the pusher must, however, come into contact in order to be able to transmit the spring force provided by the spring drive to the pressure-receiving component and thus push the door open. However, in the inactive position of the latch opener mechanism and with the door closed, the force transmission path running via the pusher can already be closed, wherein in this state, however, as yet no or only a comparatively small force is transmitted via the pusher. Where the pusher and the spring drive are arranged on the main body of the domestic appliance, the pressure-receiving component is arranged on the door or is formed by the door. It is, however, possible to arrange the pusher and the spring drive on the door; in this case, the main body of the domestic appliance forms or comprises the pressure-receiving component.

The spring drive can have a single spring element for generating the entire drive force which is provided by the spring drive for pushing out the pusher and—consequently—for pushing open the door. Alternatively, the spring drive can comprise for this purpose a plurality of spring elements which cooperate to generate this drive force. An example of a configuration of a spring element of the spring drive is a helical spring, which is placed under compressive stress or tensile stress in order to generate at least part of the driving force of the spring drive and, on relaxing, can transmit a movement impetus directed along its helix axis to the pusher. An alternative configuration of a spring element of the spring drive is a helical spring which is placed under tension by winding about its helix axis and, on relaxing, can drive, for example, a drive pinion which is in meshing engagement with the pusher.

When the door is closed and the latch opener mechanism is inactive, the spring drive can be substantially free from tension or already under spring tension. If the spring drive is substantially free from tension when the door is closed and the latch opener mechanism is inactive, activation of the latch opener mechanism, that is to say transfer of the latch opener mechanism from the inactive position into the active position, is accompanied by an action on the spring drive by means of which at least one spring element of the spring drive is placed under spring tension. At the latest when the active position of the latch opener mechanism is reached, the spring drive then has sufficient spring tension to permit the desired pushing open of the door. If the spring drive already has a spring tension when the door is closed and the latch opener mechanism is inactive, activation of the latch opener mechanism can be accompanied by an increase in this spring tension; however, the spring tension that prevails when the door is closed and the latch opener mechanism is inactive can alternatively already be the greatest tension to which the spring drive is subject under normal, regular operating conditions of the mechanism according to the invention.

The spring force (drive force) provided by the spring drive is sufficiently great in some embodiments to move the pusher by a distance such that an opening gap of at least 3 cm or at least 4 cm or at least 5 cm or at least 6 cm is formed between the door and the main body of the domestic appliance. The actuator, on the other hand, only has to be able to transfer the latch opener mechanism from the inactive position into the active position. In some embodiments, this requires an actuation stroke of the actuator that is shorter, in particular considerably shorter, than the distance by which the pusher must be advanced by the spring drive in order to achieve the mentioned size of the opening gap of the door. The stroke required to transfer the latch opener mechanism from the inactive position into the active position can be limited in some embodiments, for example, to several millimeters to about 1 to 2 cm. Accordingly, it can be sufficient in some embodiments to use a comparatively short-stroke linear actuator, for example in the form of a wax motor. It will be appreciated that other types of actuator, for example an electric motor, for operating the latch opener mechanism are not excluded at all.

In some embodiments, the holding-closed action of the door latch is overcome in the active position of the latch opener mechanism. In other embodiments, it can be that part, in particular a large part, of the holding-closed action of the door latch has already been overcome when the latch opener mechanism reaches the active position. However, a residual part of the holding-closed action of the door latch may still be present when the latch opener mechanism reaches the active position, although this residual part is sufficiently weak to be overcome by the force of the spring drive.

In some embodiments, the mechanism according to the invention further comprises a movably arranged blocking member which is separate from the latch opener mechanism and which, in a blocking position with the door closed, is able to exert on the pusher a blocking action such that a relaxation of the spring drive that is required for pushing open the door is prevented. With the door initially closed, the blocking member moves, in dependence on a displacement of the latch opener mechanism from the inactive position in the direction towards the active position, into a release position in which the blocking action of the blocking member on the pusher is lifted. When the blocking member is in the blocking position (with the door closed), the force transmission path of the pusher can be free of force transmission. In particular, the pusher can in this situation be at a distance from a pressure-receiving component to which the pusher transmits the force of the spring drive as it pushes the door open. This allows predefined specifications for the force conditions of the door latch to be observed precisely even within the context of mass production.

In some embodiments, the blocking member can be moved back into the blocking position by closing the previously pushed-open door. This makes it possible, after the door has automatically been pushed open, to transfer the pusher into a retracted position, by subsequently closing the door manually, in which it remains as a result of blocking by the blocking member and from which it is not pushed forward again by the force of the spring drive if the door is subsequently opened again manually by the user. Each time the user wishes to place individual pieces of crockery into the dishwasher, he opens the door, optionally pulls out the crockery baskets located in the dishwashing container, places the pieces of crockery into them, pushes the crockery baskets back in and closes the door again. This operation may be repeated several times before the machine is completely full and the user starts a new program run. It is advantageous if the pusher is not moved by the spring drive from a retracted position into an advanced position each time the door is opened by hand. This can be prevented in that closing the previously pushed-open door effects a return of the blocking member into the blocking position. The blocking of the pusher by the blocking member is then maintained until the latch opener mechanism is activated again.

In some embodiments, the pusher, as a result of the door being pushed open, moves into an advanced position in which it is within reach of an operator of the domestic appliance. In the blocking position of the blocking member, on the other hand, the pusher can be fixed in a retracted position in which the pusher is out of reach of the operator. In the retracted position, the pusher is arranged, for example, so that it is sufficiently recessed that it is out of reach of the hands of the user when the user is loading or unloading the domestic appliance.

In some embodiments, the latch opener mechanism, when it is displaced with the door closed from the inactive position in the direction towards the active position, acts in a force-exerting manner on a component of the door latch. For example, where the door latch is configured with a pair of spring-biased latch arms which are movable relative to one another (as disclosed, for example, in DE 10 2012 016 541 A1 or DE 10 2011 011 662 A1), the latch opener mechanism, when activated, can act on one or on both of the latch arms. In such embodiments, the blocking member can be capable of being urged by the latch opener mechanism, in dependence on the displacement thereof from the inactive position in the direction towards the active position, from the blocking position into the release position, wherein the blocking member in the release position allows the latch opener mechanism to be displaced back into the inactive position. For example, the latch opener mechanism can have a movably arranged latch opener component having a control ramp running at an angle to the direction of movement thereof for controlling the position of the blocking member.

In other embodiments, the latch opener mechanism, when it is displaced with the door closed from the inactive position in the direction towards the active position, can act in a force-exerting manner on the pusher. In these embodiments, the latch opener mechanism works indirectly against the resistance of the door latch in that it does not act directly on a component of the door latch by physical contact but initiates opening of the door by force transmission in the force transmission path containing the pusher. The blocking member can thereby be capable of being urged from the blocking position into the release position by an exertion of force on the pusher imparted by the latch opener mechanism.

In some embodiments, the blocking member has or comprises a linearly movable slider component, in particular a slider component which is displaceable between the blocking position and the release position in a direction perpendicular to the direction of movement of the pusher. In other embodiments, the blocking member is or comprises a pivot component or a rotary component.

The blocking member can be under a spring bias which biases the blocking member into the blocking position, for example. In some embodiments, the blocking member can also be under a spring bias in the release position, which biases the blocking member against leaving the release position. Accordingly, the blocking member can be spring-biased in a monostable or bistable manner.

In some embodiments, a coupling assembly is provided between the latch opener mechanism and the spring drive in order to build up or increase a spring tension of the spring drive in dependence on a displacement of the latch opener mechanism from the inactive position in the direction towards the active position with the door closed. The coupling assembly comprises, for example, a tensioning lever which is pivotable about a lever axis and which can be coupled in terms of movement with the latch opener mechanism at a point that is relatively closer to the axis and which can act on the spring drive at a point that is relatively further away from the axis. In the region of the point that is relatively further away from the axis, the tensioning lever can be coupled in terms of movement with a support member which is arranged so as to be linearly movable in the same direction of movement as the pusher, wherein a drive spring of the spring drive is supported between the support member and the pusher. Alternatively, it is conceivable that a drive spring of the spring drive is supported directly on the tensioning lever without the interposition of a separate support member.

Some embodiments provide that the door latch comprises a closing mechanism which is arranged so as to be displaceable between a closed state and an open state and which in the closed state retains a counter-body for holding the door closed, which on closing of the door comes into closing engagement with the closing mechanism, and in the open state releases the counter-body for opening of the door. The closing mechanism can have, for example, a pair of latch arms which are arranged so as to be movable relative to one another, as disclosed in DE 10 2012 016 541 A1 or DE 10 2011 011 662 A1. In such embodiments, the counter-body—depending on the direction of the spring biasing of the latch arms (towards one another or away from one another)—can be formed by a latch head according to DE 10 2012 016 541 A1 or by a mouth body forming a closing mouth according to DE 10 2011 011 662 A1. Alternatively, the closing mechanism can comprise a rotary gripper which is able to grip with a gripping mouth a stirrup web serving as the counter-body, according to DE 198 37 248 A1. It will be appreciated that the invention is not limited to these exemplary configurations of the closing mechanism and of the counter-body and that other configurations of the door latch are possible at all times.

In some embodiments, the door latch further comprises a closing spring assembly which provides a resistance to a displacement of the closing mechanism from the closed state in the direction towards the open state. In such embodiments, the latch opener mechanism is able to urge the closing mechanism, by physical contact, from the closed state against the resistance of the closing spring assembly in the direction towards the open state. The displacement stroke of the latch opener mechanism between the inactive position and the active position is in some embodiments at least sufficient to effect a transfer of the closing mechanism from the closed state into the open state when the door is closed.

According to a further aspect, the invention provides a mechanism, which can be implemented independently of the actuator-driven latch opener mechanism, for a door of a domestic electrical appliance, comprising: a door latch for holding the door closed; a movably, in particular linearly movably, arranged pusher; a pressure receiver, wherein one of the pusher and the pressure receiver is arranged on the door and the other of the two is arranged on a main body of the domestic appliance which holds the door in a movable manner; a spring drive for providing a spring force which acts on the pusher and which, after a holding-closed action of the door latch has been overcome, permits the door to be pushed open by the pusher, wherein, for pushing open the door, the pusher is configured to transmit the spring force to the pressure receiver by physical contact in a force transmission path which bypasses the door latch, wherein the pusher and the pressure receiver are movable into a relative stand-by position in which they are free of force transmission when the door is closed.

Such a relative position of the pusher and the pressure receiver that is free of force transmission is present inter alia when there is no physical contact between the pusher and the pressure receiver, that is to say when they are arranged at a distance from one another. Freedom from force transmission can also be present when the pusher and the pressure receiver are in mutual contact but no pushing forces are transmitted between them. The state of freedom from force transmission between the pusher and the pressure receiver (when the door is closed) facilitates the observance of predefined specifications in respect of the force conditions of the door latch.

The pressure receiver is a body to which the pusher transmits the spring force of the spring drive in order to push open the door. If the pusher is arranged on the main body of the domestic appliance (e.g. in the case of a dishwasher on the dishwashing container), the pressure receiver can be formed, for example, by a lining panel which lines the door on the door inner side facing the main body.

In some embodiments, the pusher has an associated spring-loaded retraction member which, in dependence on a closing of the door and contrary to a spring action of the spring drive, is able to urge the pusher out of physical contact with the pressure receiver. The retraction member ensures that the pusher is at a distance from the pressure receiver after the door has been closed.

In some embodiments, the retraction member has a blocking function for the pusher and is arranged so as to be movable between a blocking position and a release position. The retraction member, in the blocking position with the door closed, is able to exert on the pusher a blocking action such that a relaxation of the spring drive that is required for pushing open the door is prevented. In the release position of the blocking member, on the other hand, the blocking action on the pusher is lifted. In dependence on a closing of the door, the retraction member is able to perform a movement from the release position into the blocking position, wherein, on moving from the release position into the blocking position, it is able to exert a retraction stroke on the pusher. By configuring the retraction member with such a blocking function, it can be ensured that, after the door has been closed, the physical distance between the pusher and the pressure receiver is maintained, because the retraction member moves into its blocking position in dependence on the closing of the door and in the blocking position blocks the pusher. Following operation of the pusher which has led to the door being pushed open, the pusher can be brought into a retracted position and locked in that position by manually closing the door once. Therefore, when the door is subsequently opened manually, the pusher remains in its retracted position and does not protrude in such a manner that it could cause injury into the space in which the user moves his hands, for example in order to load or unload the domestic appliance.

In other embodiments, the spring drive has a drive spring which is supported between the pusher and a movably arranged support member. The support member is coupled in terms of driving with an electrically controlled actuator by means of which the support member is movable from a relative rest position with respect to the pusher into a relative tensioning position in order to build up or increase a spring tension of the drive spring. In the relative rest position of the support member, with the door closed, the pusher and the pressure receiver are able to assume the relative stand-by position. In these embodiments, the spring drive, when the support member assumes the relative rest position and the pusher and the pressure receiver are in the relative stand-by position, can be free from tension or already under spring tension. The support member can be coupled with the actuator via a lever drive, for example. By suitably configuring the lever drive, a comparatively large movement stroke of the support member and thus a sufficient build up or increase of tension in the spring drive can be achieved with a comparatively small actuation stroke of the actuator.

According to a further aspect, the invention provides a mechanism for a door of a domestic electrical appliance, wherein the mechanism comprises: a door latch for holding the door closed, wherein the door latch comprises a pair of spring-biased latch arms which are arranged so as to be pivotable relative to one another between a closed state and an open state and which in the closed state retain a counter-body for holding the door closed, which comes into closing engagement with the latch arms on closing of the door, and in the open state release the counter-body for opening of the door; a latch opener mechanism which cooperates mechanically with the latch arms and which, when the door is closed, is configured to be transferred from an inactive position into an active position in order thereby to urge the latch arms from the closed state in the direction towards the open state; and a wax motor for driving the latch opener mechanism.

According to yet a further aspect, the invention provides a mechanism for a door of a domestic electrical appliance, comprising: a movably, in particular linearly movably, arranged pusher; a spring drive which acts on the pusher; a movably arranged blocking member which, in a blocking position with the door closed, is able to exert on the pusher a blocking action such that a relaxation of the spring drive that is required for pushing open the door is prevented; and an electrically controllable actuator for exerting a force on the pusher in order to overcome the blocking action of the blocking member on the pusher.

A further aspect of the invention provides a mechanism for a door of a domestic electrical appliance, comprising: a movably, in particular linearly movably, arranged pusher; a spring drive which acts on the pusher; a movably arranged blocking member which, in a blocking position with the door closed, is configured to exert on the pusher a blocking action such that a relaxation of the spring drive that is required for pushing open the door is prevented; a movably arranged control member, separate from the pusher, for controlling the position of the blocking member; and an electrically controllable actuator for exerting a force on the control member in order to overcome the blocking action of the blocking member on the pusher.

Finally, the invention also provides a domestic dishwasher which comprises: a dishwashing container which delimits a dishwashing chamber; a door which is mounted on the dishwashing container so as to be pivotable about a horizontal pivot axis close to the floor; and a mechanism of the type explained hereinbefore. It can be optionally provided that the door is free of the action of a hinge spring assembly which biases the closed door in the opening direction. Such a hinge spring assembly for the door can consequently be omitted; even without hinge springs with an opening action it is possible by means of the mechanism according to the invention to achieve a sufficiently large opening gap of the door without the assistance of the user.

BRIEF DESCRIPTION OF THE DRAWINGS

The invention will be explained in greater detail hereinbelow with reference to the accompanying drawings, in which:

FIG. 3 shows, in perspective, the latch and opener module of FIG. 2*a*, but wherein some built-in components of the latch and opener module have been omitted for the sake of clarity.

DETAILED DESCRIPTION

Figure 1:
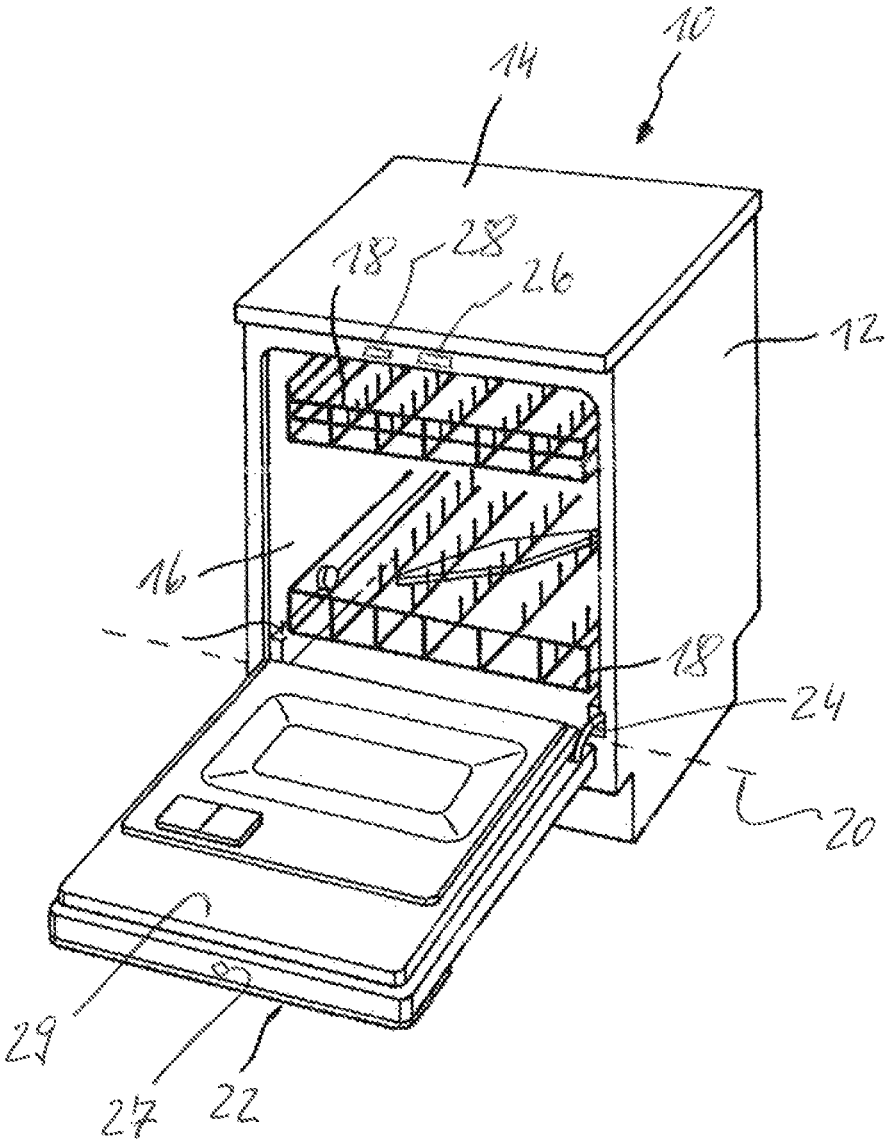
FIG. 1 shows, in perspective, a domestic dishwasher according to an exemplary embodiment.

Reference will first be made to FIG. 1. The domestic dishwasher shown therein is generally designated 10. It comprises a dishwashing container (appliance main body) 12 having a container top 14 and a dishwashing chamber 16 which is delimited laterally, at the top, at the bottom and at the rear by the dishwashing container 12 and is open at the front and in which one or more crockery baskets 18 and, if desired, further carriers for items of tableware, for example a cutlery drawer, can be accommodated in a manner known per se. A door 22 by means of which the dishwashing chamber 16 can be closed at the front is mounted on the dishwashing container 12 so as to be pivotable about a horizontal pivot axis 20 close to the floor. Close to the floor here means that the pivot axis 20 extends close to the foot region of the dishwashing container 12 which stands on the ground (floor).

In FIG. 1, the door 22 is shown in a fully open position in which—from the point of view of a user standing in front of the dishwasher 10—it has been folded down forwards into a substantially horizontal orientation. By being folded upwards, the door 22 can be brought into a closed position in which it is oriented with its door plane substantially vertical. 24 indicates a door hinge which serves to pivotably mount the door 22 on the dishwashing container 12. The door hinge 24 can have associated hinge springs (not shown in detail in FIG. 1) which, at least in some positions of the door 22, exert a spring bias on the door 22. However, the dishwasher 10 does not have hinge springs which exert a spring bias which acts in the opening direction when the door 22 is in the closed, that is to say vertical, position. Therefore, after the holding-closed force of a door latch, which is able to hold the door 22 in its closed position, has been overcome and after a door seal (which extends on the front side of the dishwashing container 12 around the access opening to the dishwashing chamber 16 and is compressed on closing of the door 22), which is not shown in detail in FIG. 1 but is generally conventional in domestic dishwashers, has been decompressed, no bias acts on the door 22 which would be strong enough to open the door 22 further without other assistance.

The mentioned door latch is composed of two basic components which come into engagement with one another on closing of the door 22 for the purpose of holding the door 22 closed, namely a latch unit 26 and a counter-body 27. In FIG. 1, the latch unit 26 and the counter-body 27 are indicated only schematically; possible concrete configurations will be explained in connection with the further figures. In the example shown, the latch unit 26 is arranged on the dishwashing container 12 at a point above the dishwashing chamber 16 and beneath the container top 14, while the counter-body 27 is arranged on the door 22 in the region of an upper door edge remote from the floor. It will be appreciated that this arrangement pattern of the latch unit 26 and the counter-body 27 is by way of example and that in other embodiments the latch unit 26 can be arranged on the door 22 and the counter-body 27 can be arranged on the dishwashing container 12.

With the door 22 closed, when the counter-body 27 is caught in the latch unit 26, the latch unit 26 provides resistance to opening of the door 22. A user who wishes to open the door 22 by hand must overcome this resistance. To this end, the user must manually apply a certain opening force.

The dishwasher 10 additionally has an automatic door opening function which allows the door 22 to be opened at least slightly without manual intervention by the user. Because of the absence of hinge springs with an opening biasing action, it is not sufficient for the door opening function of the dishwasher 10 simply to overcome the holding-closed action of the latch unit 26, since there would then still not be a sufficiently large opening gap between the door 22 and the dishwashing container 12. Instead, the door opening function of the dishwasher 10 must be suitably configured to provide the door 22 with a certain movement impetus, by which the door 22 is pushed open by the required amount, after the holding-closed action of the latch unit 26 has been overcome.

In order to achieve the door opening function, the dishwasher 10 has an opener unit 28, indicated schematically in FIG. 1, which in the example shown is arranged on the dishwashing container 12 and contains a pusher (not shown in FIG. 1) to which a movement impetus can be applied by a spring drive. On activation of the opener unit 28, the pusher transmits the pushing force provided by the spring drive to a pressure receiver, which in the example shown is arranged on the door 22 and is formed, for example, by an inner lining panel 29 of the door 22. By means of the pushing forwards of the pusher on relaxation of the spring drive, the door 22 is pushed open. The force transmission path in which the pushing force of the spring drive is transmitted from the pusher to the door 22 passes the force transmission path in which the holding-closed force is transmitted between the latch unit 26 and the counter-body 27. Consequently, two mechanically parallel force transmission paths between the dishwashing container 12 and the door 22 are defined, one via the latch unit 26 and the other via the opener unit 28.

It will be appreciated that the opener unit 28 can alternatively be arranged on the door 22. In this case, part of the container wall of the dishwashing container 12 serves as the pressure receiver, for example part of a front wall of the dishwashing container 12 that is situated beneath the container top 14 but above the dishwashing chamber 16. If the latch unit 26 and the opener unit 28 are both arranged on the dishwashing container 12 or are both arranged on the door 22, the two units 26, 28 can be structurally integrated in a joint latch and opener module. However, it is of course equally possible to design the latch unit 26 and the opener unit 28 as separate structural modules which are mounted separately from one another on the dishwashing container 12 or on the door 22.

The further figures show various exemplary embodiments which provide the door opening function which has been explained. For all the figures, identical components or components which have an identical action are provided with identical reference signs, wherein an appended lowercase letter shows that it is a different exemplary embodiment. Unless otherwise indicated in the description of a specific exemplary embodiment, reference is made for the explanation of such identical components or components which have an identical action to the comments made in connection with a preceding exemplary embodiment.

Reference will now be made to FIGS. 2*a* to 2*d* and the exemplary embodiment of an integrated latch and opener module 30 shown therein. This latch and opener module 30 combines the functions of the latch unit 26 and the opener unit 28 of FIG. 1. The latching function of the latch and opener module 30 cooperates with a latch head 32, which represents an example of the counter-body 27 of FIG. 1. The latch and opener module 30 is a self-contained structural unit with a module housing 34 by means of which the latch and opener module 30 can be fastened to a superordinate component, for example the dishwashing container 12 of FIG. 1. All the mechanical and electromechanical components which are required to cooperate with the latch head 32 for the purpose of holding closed the door of a domestic electrical appliance, for example the door 22 of FIG. 1, and providing an automatic opening function for the door are accommodated in the module housing 34. In order to achieve the latching function, a pair of latch arms 36 are accommodated in the module housing 34 so as to be rotatable about a respective arm rotary axis 38. The latch arms 36 are biased in the direction towards one another by a closing spring 40. When the door is closed, the latch arms 36 grip the latch head 32 on both sides; for opening the door, the latch arms 36 must be urged away from one another against the force of the closing spring 40 in order that a sufficiently large gap is formed between the free arm tips, designated 42, of the latch arms 36 to allow the latch head 32 to be released from the grip of the latch arms 36 and move out between the two latch arms 36. This latching function of the latch and opener module 30 corresponds to the latch unit 24 shown in FIG. 2 of DE 10 2012 016 541 A1 and explained in the description of that document. The latch arms 36 form or are part of a closing mechanism within the meaning of the present disclosure.

Opening of the door is possible in that a user pulls the door and thereby removes the latch head 32 from being gripped by the two latch arms 36. In addition to this possibility for manual opening, the latch and opener module 30 offers an automatic opening function. To this end, the latch assembly 30 is designed with an arm ram 44 which is movable forwards and backwards in a linear direction by means of an electrically controllable actuator 46. The arm ram 44 is coupled with a piston 47 (FIG. 2*b*) of the actuator 46 for push and pull transmission. In the situation according to FIG. 2*a*, the arm ram 44 is shown in a retracted, inactive position. By operating the actuator 46, which can comprise, for example, a wax motor, the arm ram 44 can be activated, wherein it moves with a ram tip 48 between two mutually facing arm projections 50 of the latch arms 36 and thereby drives the two latch arms 36 apart against the force of the closing spring 40.

FIG. 2*b* shows the arm ram 44 in its advanced, that is to say active position, in which the latch arms 36 in the region of their arm tips 42 are spread so far apart that the latch head 32 is able to move out between the arm tips 42. The arm ram 44 forms or is part of a latch opener mechanism within the meaning of the present disclosure. Instead of an electrically controllable wax motor, the actuator 46 can of course also comprise a different type of motor, for example an electric motor. Non-motor actuator types, such as, for example, an electromagnetic actuator, are also not excluded within the scope of the present disclosure.

Figure 2A:
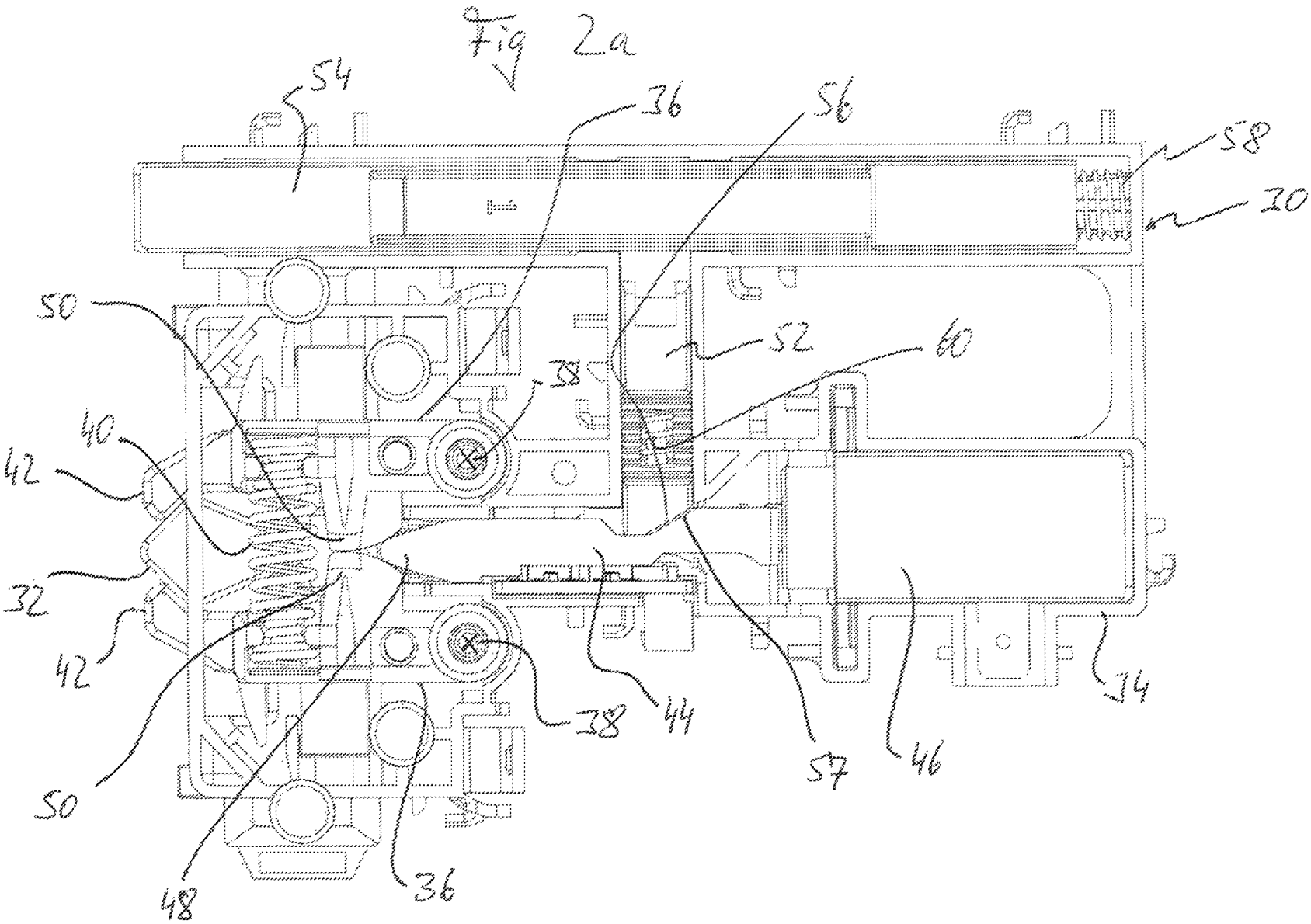
FIG. 2*a* shows an integrated latch and opener module according to an exemplary embodiment which is suitable for the dishwasher according to FIG. 1, in a state with the door closed and the door opening function deactivated.
Figure 4:
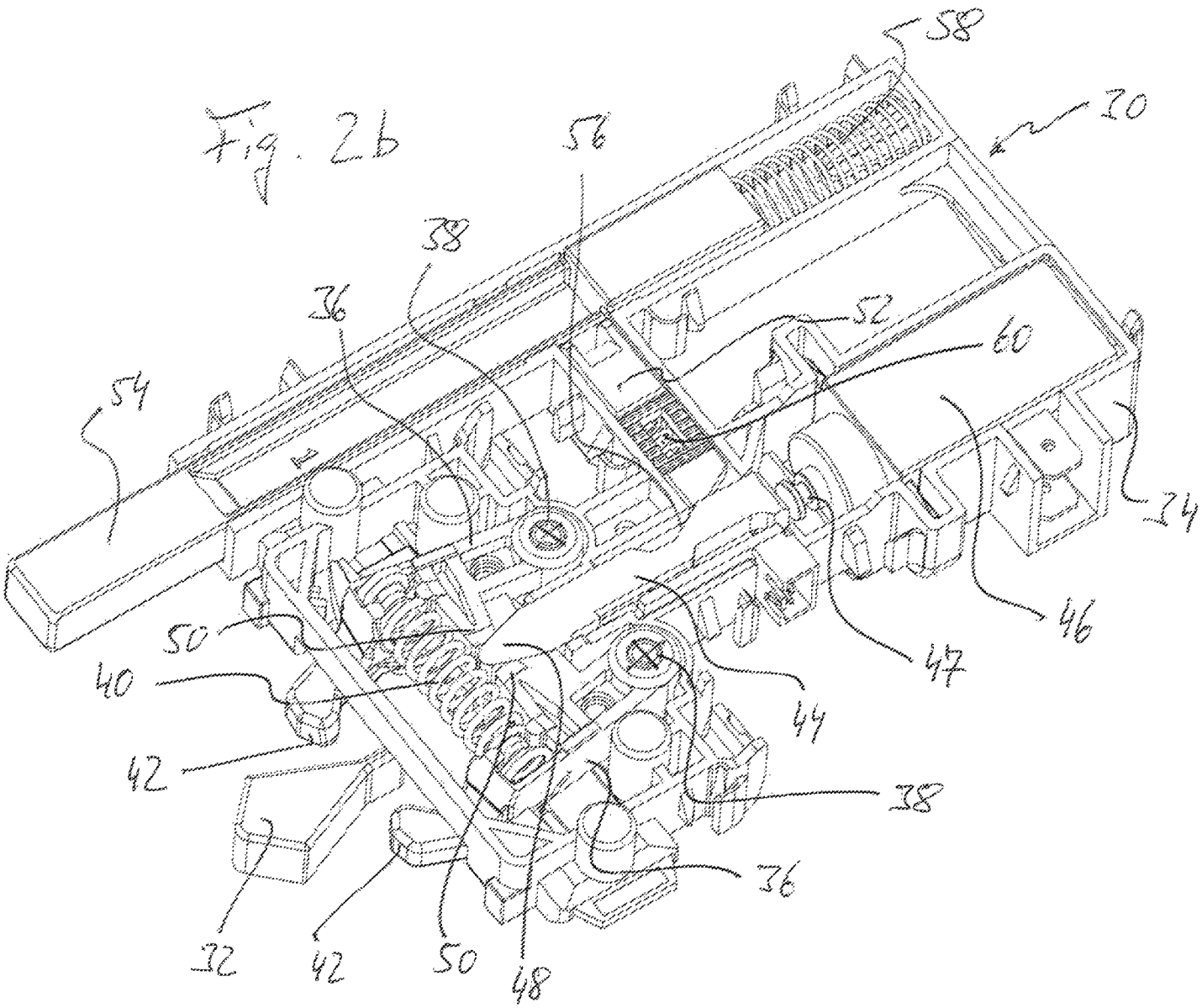
FIG. 4*a* shows the latch and opener module of FIG. 2*a* in the same situation and in the same plan view as in FIG. 2*a*, wherein a latch head of a door latch is not shown for the sake of clarity but details of a pushing slider and of a blocking slider of the door opening function are shown more clearly.
FIG. 4*b* shows the latch and opener module of FIG. 2*a* in the same plan view and with the same level of detail as in FIG. 4*a* after activation of the door opening function.

The arm ram 44 acts in a mechanically controlling manner on the position of a blocking slider 52, which is able to fix a pushing slider 54 in a retracted position shown in FIG. 2*a* and prevent it from moving into an advanced position shown in FIG. 2*b*. In the example shown, the pushing slider 54*a* is linearly movable substantially parallel to the direction of movement of the arm ram 44, while the blocking slider 52 is linearly movable in a direction substantially perpendicular to the directions of movement of the arm ram 44 and of the pushing slider 54. The blocking slider 52 occupies a blocking position in FIG. 2*a*; in this position, it blocks the pushing slider 54 against movement from the retracted position into the advanced position. By activation of the arm ram 44, the blocking slider 52 can be urged from the blocking position into a release position, in which blocking of the pushing slider 54 by the blocking slider 52 is lifted. Accordingly, the arm ram 44—in addition to its function of at least partially opening the latch arms 36—forms a control member for controlling the position of the blocking slider 52. In FIG. 2*b*, the blocking slider 52 is in its release position.

For controlling the position of the blocking slider 52, the arm ram 44 is designed with a control ramp 56 which forms a ramp path which runs at an angle to the direction of movement of the arm ram 44 and along which the blocking slider 52 slides in the manner of a path-path follower engagement when the arm ram 44 is advanced from the inactive position into the active position. The blocking slider 52 is thereby urged to the side and consequently releases the pushing slider 54. In the exemplary embodiment shown, the blocking slider 52 is designed with a sloping surface 57 which runs at substantially the same angle to the direction of movement of the arm ram 44 as the control ramp 56. The sloping surface 57 cooperates with the control ramp 56 of the arm ram 44 in the manner of wedge surfaces which slide on one another in order to convert a movement of the arm ram 44 into a transverse movement of the blocking slider 52.

After the blocking of the pushing slider 54 has been lifted, an opener spring 58 which serves as a spring drive and in the example shown is formed by a helical compression spring can relax by expanding along its helix axis and thereby push the pushing slider 54 forwards. The pushing slider 54 thereby strikes a pressure receiver and transmits an opening force thereto, whereby the door is pushed open. Assuming that the latch and opener module 30 is arranged on the dishwashing container 12 of the dishwasher 10 of FIG. 1, the pressure receiver is part of the door 22. The force transmission path in which the force of the opener spring 58 is transmitted to the pressure receiver passes the force transmission path in which, when the door is closed, the transmission of force between the latch arms 36 and the latch head 32 is effective.

The blocking slider 52 is under the biasing of a biasing spring 60, which biases the blocking slider 52 in the direction towards the blocking position according to FIG. 2*a*. In order to transfer the blocking slider 52 from the blocking position according to FIG. 2*a* into the release position according to FIG. 2*b*, the biasing action of the biasing spring 60 must therefore be overcome. As soon as the pushing slider 54, in the release position of the blocking slider 52, has jumped from the retracted position according to FIG. 2*a* into the advanced position according to FIG. 2*b*, the blocking slider 52 is blocked by the pushing slider 54 against moving back into the blocking position. Only when the pushing slider 54 is urged (against the action of the opener spring 58, which is thereby tensioned again) back into the retracted position according to FIG. 2*a* can the blocking slider 52 return from the release position back into the blocking position under the action of the biasing spring 60.

Figure 2C:
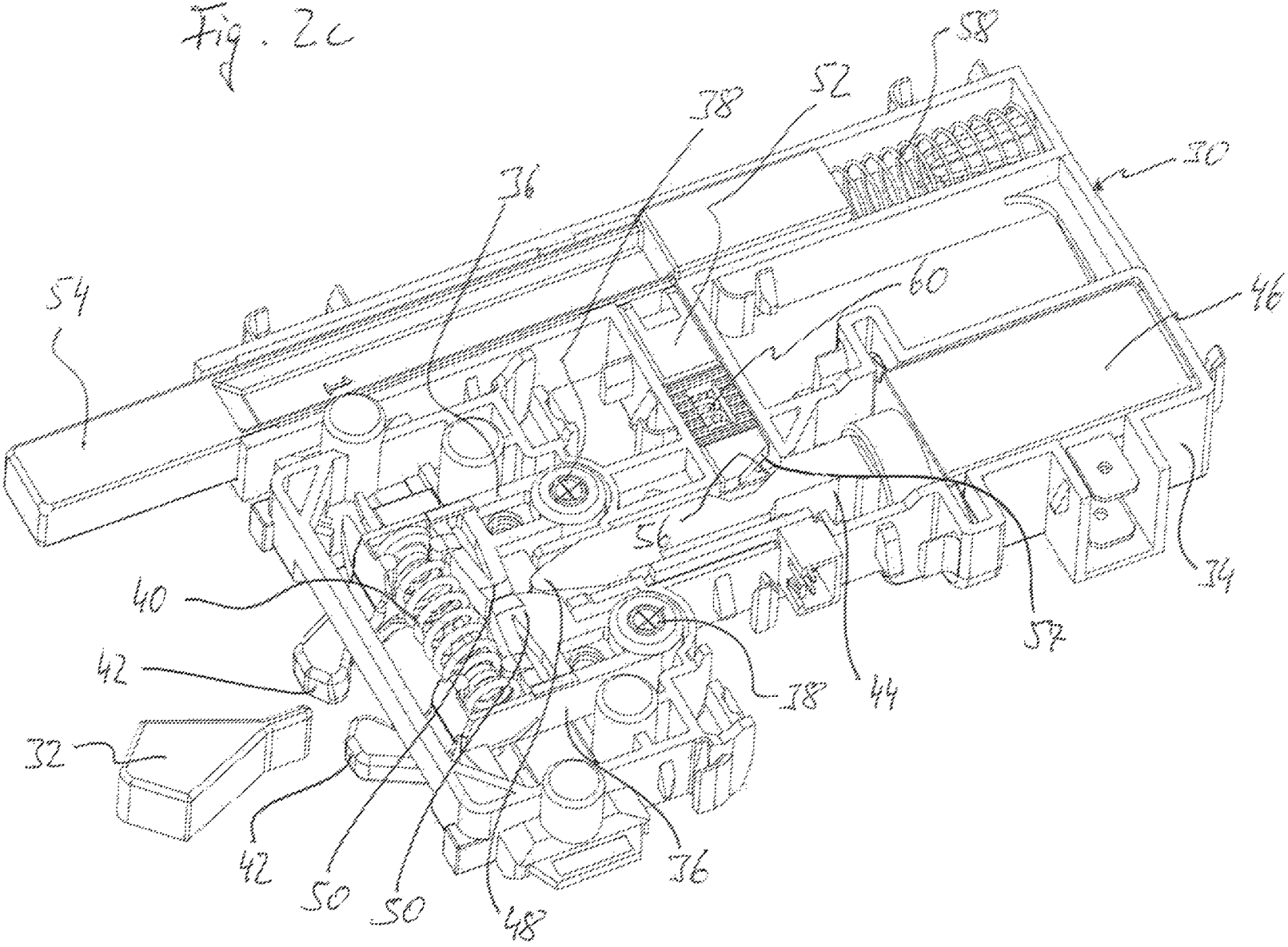
FIG. 2*c* shows the latch and opener module of FIG. 2*a* in a perspective view in a situation after the door opening function has been deactivated starting from the situation according to FIG. 2*b*, but wherein the door is still open.
Figure 2:
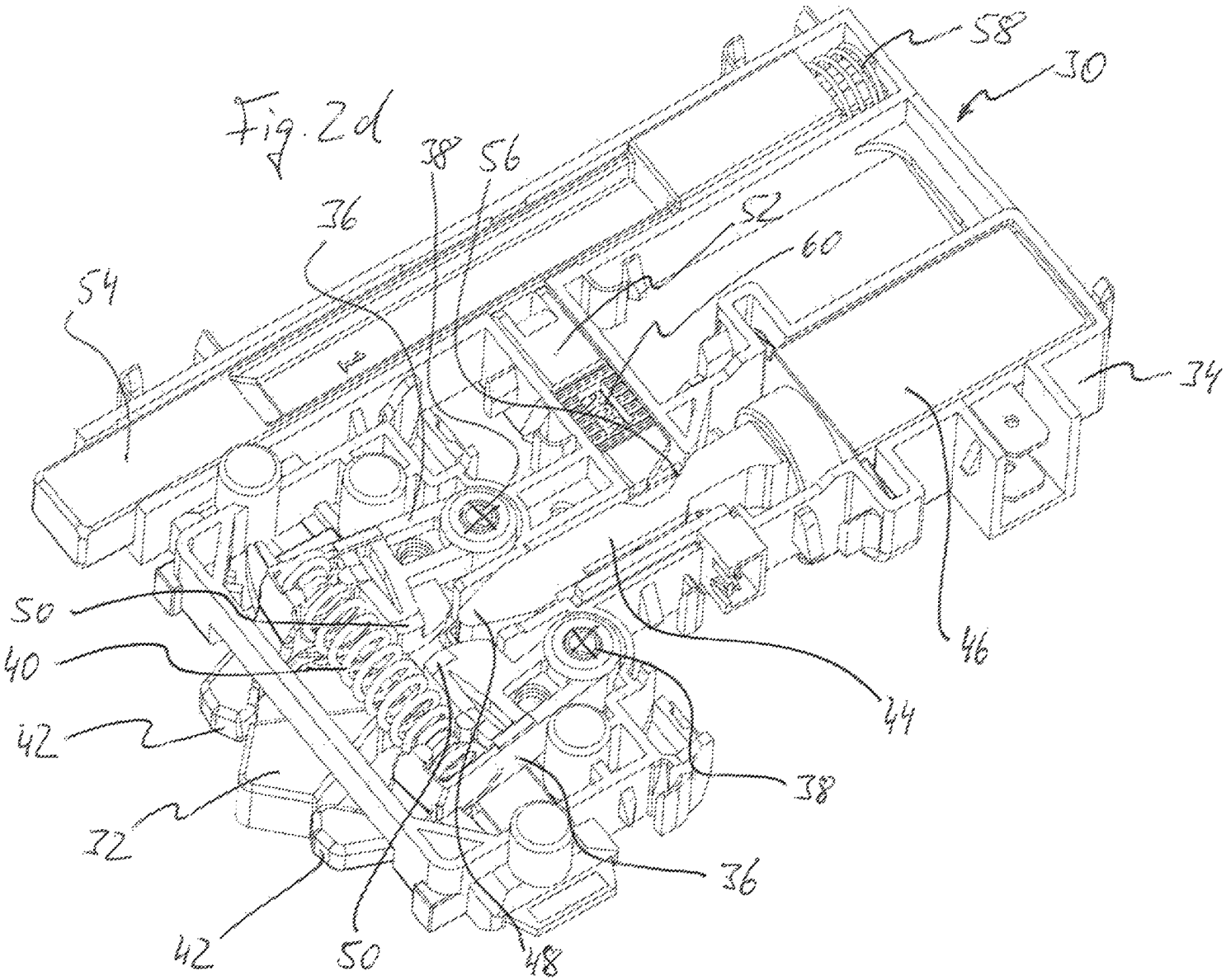
FIG. 2*b* shows the latch and opener module of FIG. 2*a* in a perspective view in a state after activation of the door opening function.
FIG. 2*d* shows the latch and opener module of FIG. 2*a* in a perspective view in a situation after, starting from the situation according to FIG. 2*c*, the door has been closed almost completely.

The blocking of the blocking slider 52 by the pushing slider 54 when the pushing slider 54 is in the advanced position does not prevent the arm ram 44 from being able to be moved back into its inactive position, after activation of the opening function of the latch and opener module 30 (i.e. after the door has automatically been pushed open), by operation of the actuator 46. The latch arms 36 are then no longer pushed apart by the arm ram 44 and can return to their closest possible rest position under the action of the closing spring 40. This situation is shown in FIG. 2*c*. The pushing slider 54 is in its advanced position, and the latch head, because the door is open, is out of reach of the latch arms 36. The arm ram 44 has moved back into its inactive position, but the blocking slider 52 is still prevented from returning to its blocking position by the pushing slider 54.

If, starting from the situation according to FIG. 2*c*, the door is closed manually by the user, the pushing slider 54 is urged back into the retracted position by the closing of the door. The blocking slider 52 thereby becomes free and is able to move back into the blocking position according to FIG. 2*a*. As a result of the closing of the door, the latch head 32 is at the same time squeezed between the latch arms 36. FIG. 2*d* shows a situation during such a closing operation of the door shortly before the completely closed door position is reached, that is to say shortly before the latch arms 36 snap together behind the latch head 32 and again grip the latch head 32 between them.

Because the pushing slider 54 is urged back into its retracted position by such manual closing of the door and the blocking slider 52 as a result moves back into its blocking position, the pushing slider 54 remains blocked in its retracted position according to FIG. 2*a* during a subsequent manual opening of the door. The pushing slider 54 can accordingly be fixed in its retracted position again by closing the door once after the opening function of the latch and opener module 30 has been activated. It therefore does not impede the user as he works in the region of the dishwasher, for example in order to load or unload dishes.

Figure 4A:
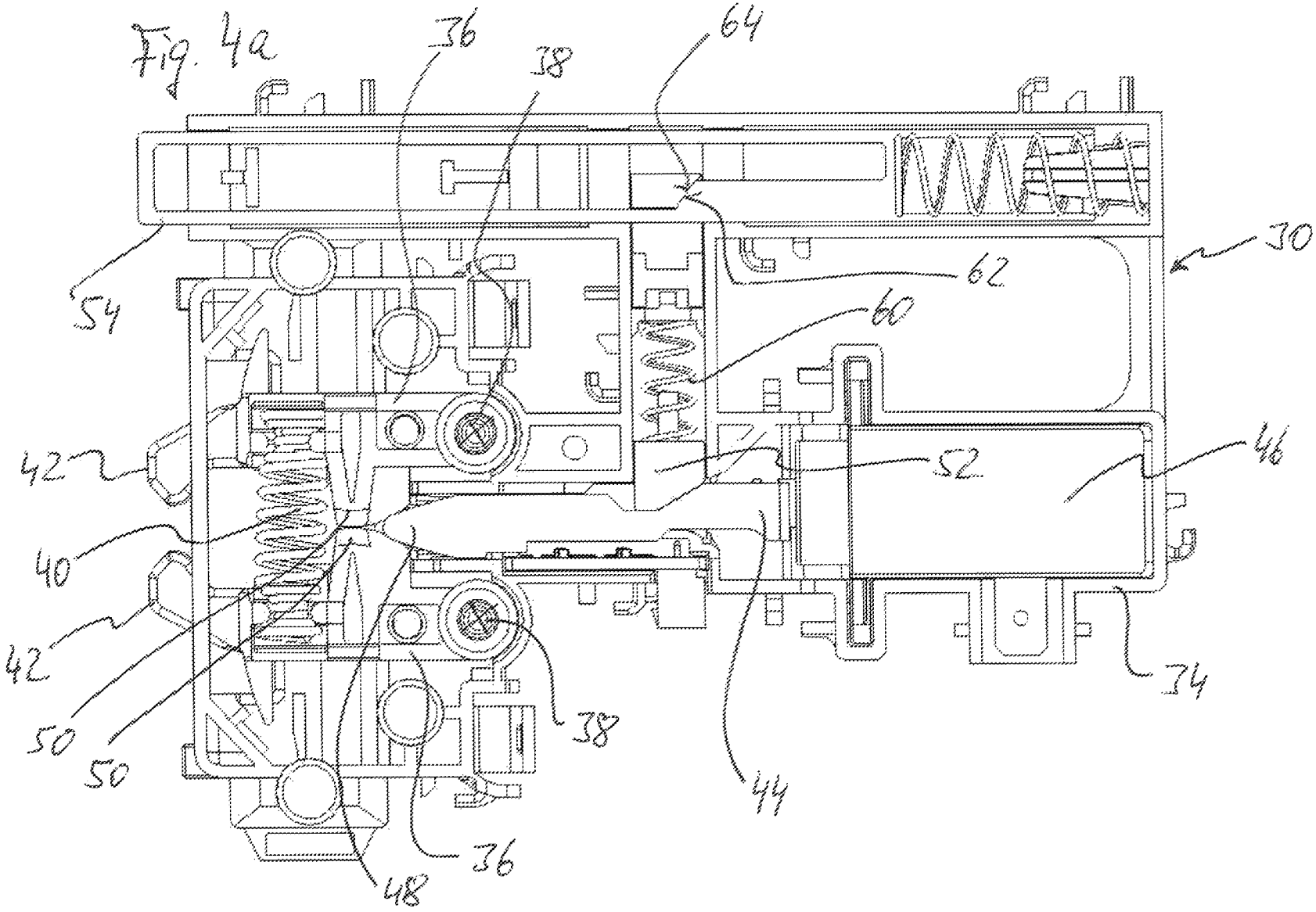
Figure 4B:
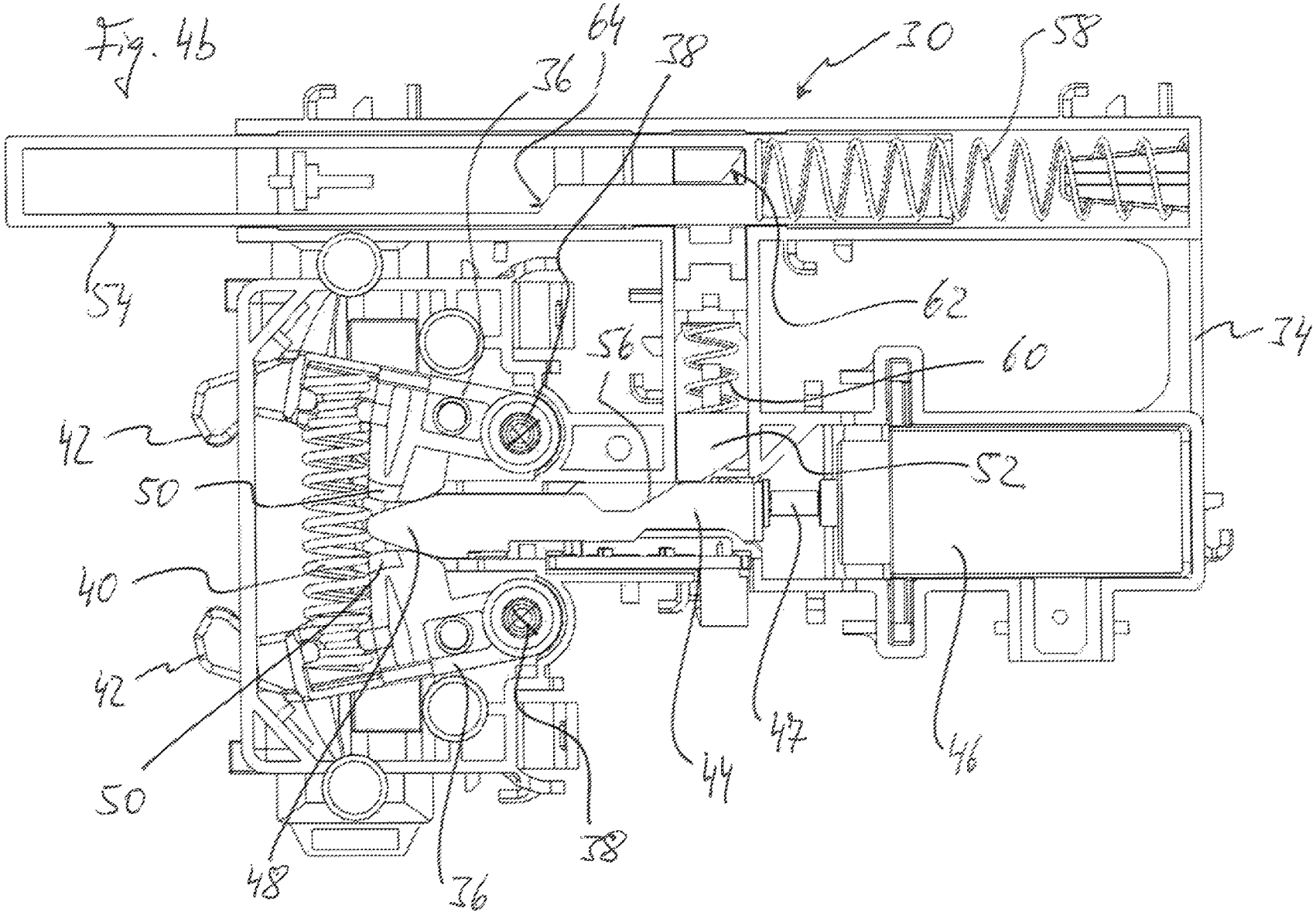
Figure 5:
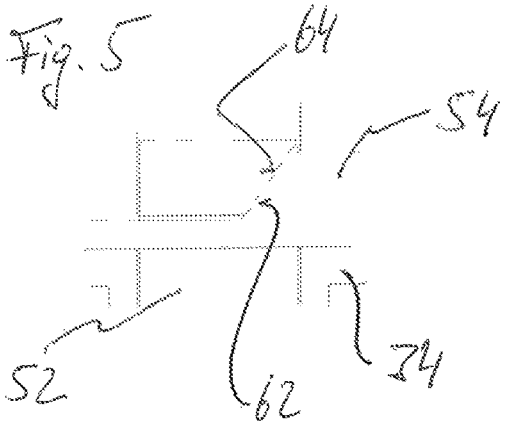
FIG. 5 shows an enlarged detail which shows a wedge engagement between the pushing slider and the blocking slider of the latch and opener module of FIG. 2*a* in the situation according to FIG. 4*a*.

Reference will now additionally be made to FIGS. 3, 4*a*, 4*b* and 5. It will be seen in these figures that a further pair of cooperating wedge surfaces 62, 64 is formed on the blocking slider 52 and the pushing slider 54. If the door is closed again by the user after the door opening function of the latch and opener module 30 has been activated, the pressure receiver pushes against the pushing slider 54. The latter is thereby urged into the module housing 34 from the advanced position in the direction towards the retracted position. The opener spring 58 is thereby tensioned again. As soon as the blocking slider 52, during the backwards movement of the pushing slider 54, is no longer held in the release position by the pushing slider 54, the biasing spring 60 urges the blocking slider 52 from the release position into the blocking position. During this movement of the blocking slider 52, the two wedge surfaces 62, 64 come into mutual wedge engagement, as is shown in FIG. 4*a*. The wedge engagement occurs even before the blocking slider 52 has finally reached its blocking position. Over the following portion of the movement path of the blocking slider 52 until it reaches the blocking position, the wedge engagement of the wedge surfaces 62, 64 causes the pushing slider 54 to be urged slightly further in the direction into the module housing 34 (against the force of the opener spring 58) than is possible by the closing movement of the door alone. This retraction stroke which is exerted by the blocking slider 52 on the pushing slider 54 releases the physical contact which initially still exists between the pushing slider 54 and the pressure receiver on closing of the door. The force transmission path between the pushing slider 54 and the pressure receiver is thereby interrupted.

Accordingly, the blocking slider 52 at the same time acts as a retraction member for the pushing slider 54. However, the retracting action of the blocking slider 52 on the pushing slider 54 is dependent on the pushing slider 54 first being moved by closing of the door into a position in which the blocking slider 52 is no longer held in the release position by the pushing slider 54. The biasing spring 60 is to be designed to be sufficiently strong that it is able, against the force of the opener spring 58, to urge the blocking slider 52 into the blocking position and thereby urge the pushing slider 54 over the last path portion into the inactive position.

Figure 6:
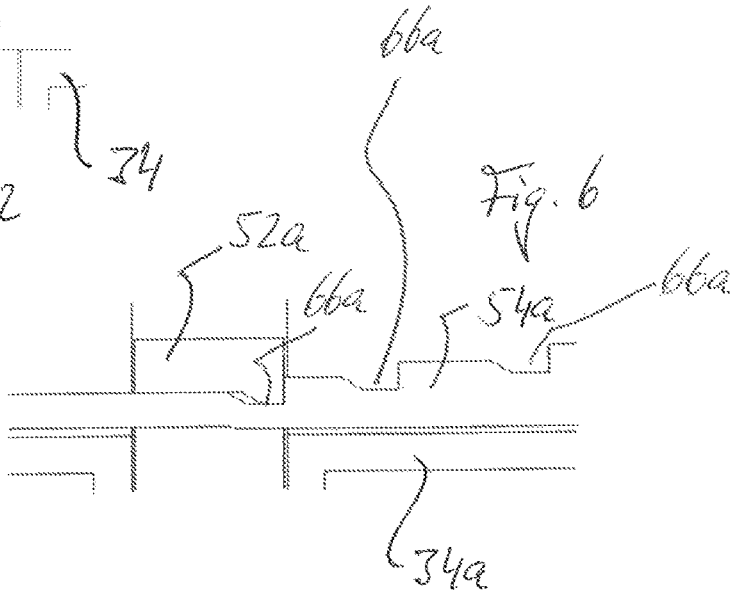
FIG. 6 shows an example of a modification of the engagement between the pushing slider and the blocking slider for the latch and opener module of FIG. 2*a*.
Figure 7:
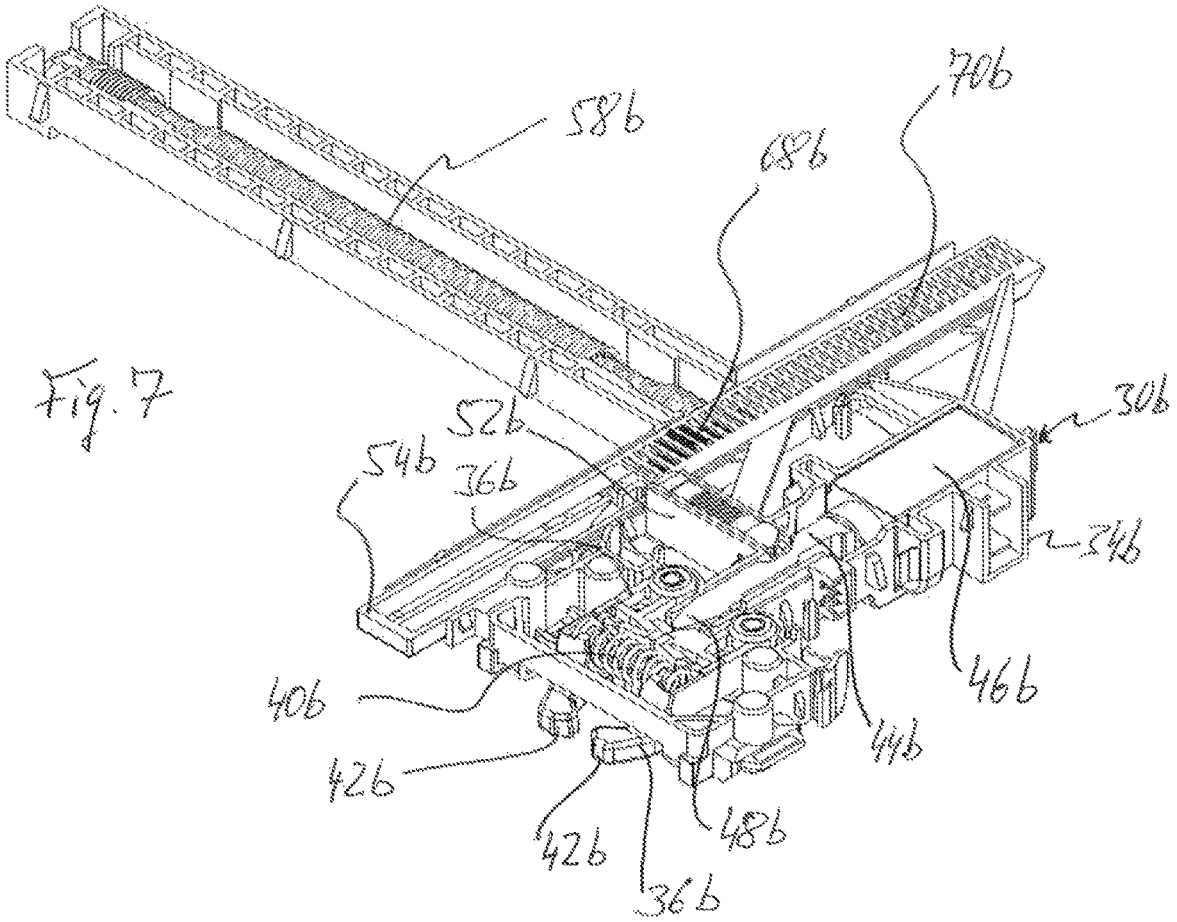

In the variant according to FIG. 6, the auxiliary slider 52*a* does not have a retracting function for the pushing slider 54*a*. However, the pushing slider 54*a* is designed with a plurality of latching depressions 66*a* along its longitudinal extent (which coincides with its direction of movement between the retracted position and the advanced position) which allow the pushing slider 54*a* to be locked stepwise as the pushing slider 54*a* is returned from the advanced position in the direction towards the retracted position. If the pushing slider 54*a*, starting from the advanced position, is urged slightly in the direction towards the retracted position until the blocking slider 52*a* is able to fall into a first of the latching depressions 66*a*, the pushing slider 54*a* remains locked in that position, even if it is subsequently not urged further in the direction towards the retracted position. However, it at least does not move back into the advanced position. If the pushing slider 54*a* is then urged slightly further in the direction towards the retracted position until the blocking slider 52*a* is able to fall into the next latching depression 66*a*, this latching depression 66*a* again effects locking of the pushing slider 54*a*. This successive, multi-step locking of the pushing slider 54*a* is expedient if, for example, after activation of the automatic door opening function, a small child who is playing leans against the door and thereby partially closes the door but the child lets go of the door again shortly before the fully closed door position is reached. The pushing slider 54*a* then does not jump back into its advanced position and abruptly push the door open again, which could involve a risk of injury to the child under certain circumstances. Instead, the pushing slider 54*a* remains in the last locking position reached.

It will be appreciated that the number of latching depressions 66*a* is not limited to three, as shown in FIG. 6. In some embodiments, only a single locking position of the pushing slider 54*a* can be implemented before the fully retracted position is reached (in this case, two latching projections 66*a* on the pushing slider 54*a* can be sufficient), while in other embodiments the pushing slider 54*a* can pass through more than two locking positions before it reaches the fully retracted position (in this case, four or more latching depressions 66*a* can be formed on the pushing slider 54*a*). It will additionally be appreciated that the configuration of the latching structures which allow the pushing slider 54*a* to be locked before it reaches the retracted position can differ from the form of the latching depressions 66*a* that is concretely shown. In particular, it will be appreciated that at least the latching depression 66*a* that locks the pushing slider 54*a* in the retracted position (in FIG. 6 this is the left-hand one of the three latching depressions 66*a* shown) can be suitably configured to achieve a wedge action comparable to the wedge surfaces 62, 64 of FIG. 5. The retracting function of the blocking slider 52 for the pushing slider 54 explained in connection with FIGS. 3, 4*a*, 4*b*, 5 can thus readily be combined with the principle explained in connection with FIG. 6 of multi-step locking of the pushing slider 54*a* on the path from the advanced position to the retracted position.

Figure 7:
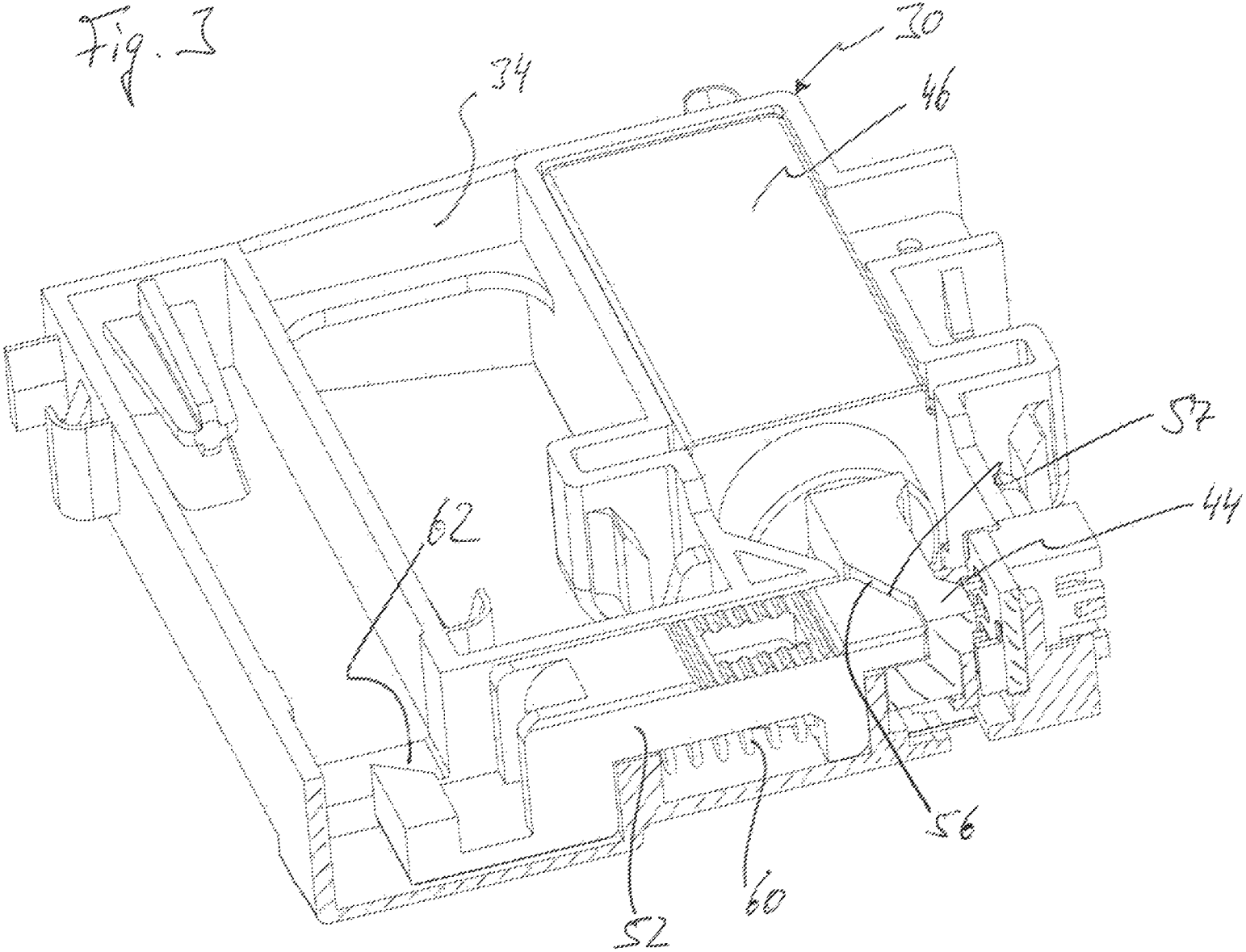
FIG. 7 shows, in perspective, an integrated latch and opener module according to a further exemplary embodiment.

In the exemplary embodiment of FIG. 7, a helical spring again serves as the opener spring 58*b* for driving the pushing slider 54*b*. However, this is tensioned by winding about its helix axis so that, when the opener spring 58*b* is released, a drive pinion 68*b* can be driven in rotation about the helix axis by the spring energy that is released. The drive pinion 68*b* is in meshing engagement with a toothing 70*b* formed on the pushing slider 54*b*. For generating sufficiently great tension in the opener spring 58*b*, a comparatively large length of the opener spring 58*b* along its helix axis may be required. When the opener spring 58*b* is arranged with its helix axis substantially perpendicular to the direction of movement of the pushing slider 54*b* (as shown in FIG. 7), the fitting of the latch and opener module 30*b* into the dishwashing container of a dishwasher can nevertheless be possible with comparatively few complications since there can be sufficient installation space in the horizontal lateral direction beneath the container top of the dishwashing container to accommodate the opener spring 58*b* there.

Figure 8A:
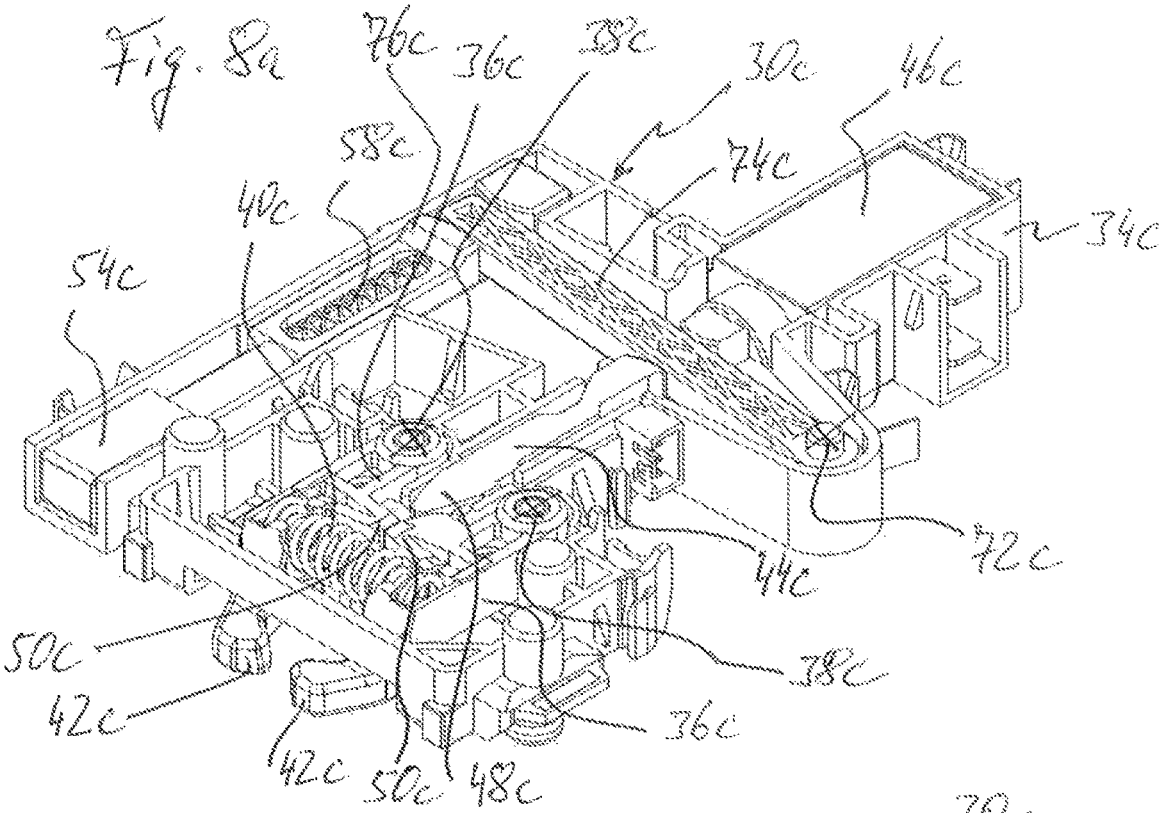
FIG. 8*a* shows, in perspective, an integrated latch and opener module according to yet a further exemplary embodiment.
Figure 8B:
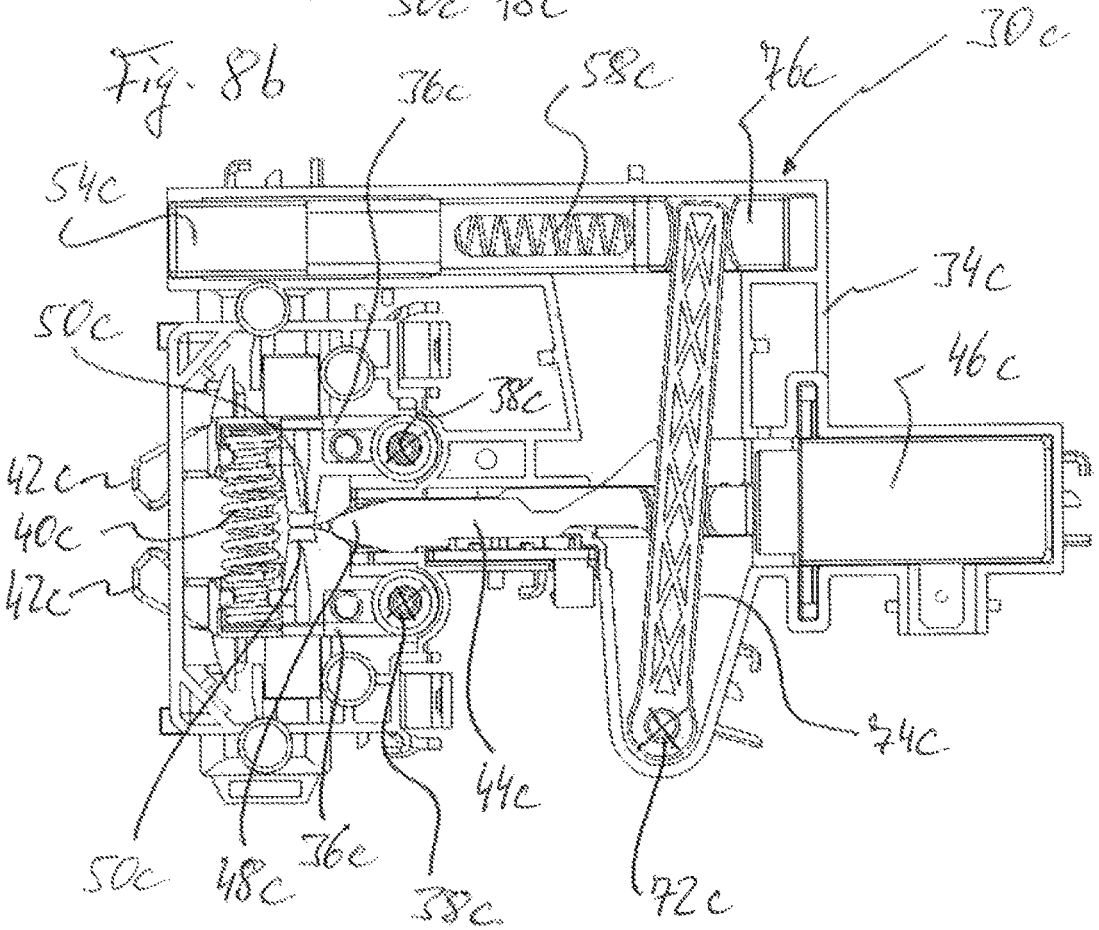
FIG. 8*b* shows the latch and opener module of FIG. 8*a* in a plan view.

In the exemplary embodiment of FIGS. 8*a* and 8*b*, the arm ram 44*c* is coupled in terms of movement with a coupling lever (tensioning lever) 74*c* which is mounted on the module housing 34*c* so as to be pivotable about a lever axis 72*c*. A movement of the arm ram 44*c* is therefore accompanied by pivoting of the coupling lever 74*c*. There is further coupled with the coupling lever 74*c* a support member 76*c* which can also be referred to as a tensioning slider and which is arranged parallel to the pushing slider 54*c* so as to be movable relative thereto. The opener spring 58*c* is supported between the pushing slider 54*c* and the tensioning slider (support member) 76*c*.

In FIGS. 8*a*, 8*b*, the two sliders 54*c*, 76*c* are shown in a relative rest position, in which the two sliders 54*c*, 76*c* are at a defined greatest possible distance from one another and the opener spring 58*c* is in a state of minimum spring tension. This state can be a largely tension-free state, or the opener spring 58*c* can already be under a certain spring tension in the relative rest position of the sliders 54*c*, 76*c*. The defined greatest possible distance of the sliders 54*c*, 76*c* can be given by cooperating stop surfaces, not shown in detail in the drawings, on the two sliders 54*c*, 76*c*.

When the arm ram 44*c* is driven, the tensioning slider 76*c* is moved synchronously owing to the movement coupling via the coupling lever 74*c*. If the arm ram 44*c* is driven starting from its inactive position and if the door is still closed, the tensioning slider 76*c* moves closer relative to the pushing slider 54*c*. The opener spring 58*c* is thereby tensioned more greatly. The spring tension building up in the opener spring 58*c* cannot be discharged, however, because the pushing slider 54*c* is prevented from jumping forwards by the still closed door. It is conceivable that, in the inactive position of the arm ram 44*c*, the pushing slider 54*c* is already in physical contact with the pressure receiver. In some embodiments, however, the pushing slider 54*c* is not in physical contact with the pressure receiver in the inactive position of the arm ram 44*c*, that is to say it is at a distance from the pressure receiver. In such embodiments, when the arm ram 44*c* is activated, the "packet" of the pushing slider 54*c*, the opener spring 58*c* and the tensioning slider 76*c* first jointly moves forwards without the blocking slider 76*c* moving relatively closer to the pushing slider 54*c*. Only when the pushing slider 54*c* strikes the pressure receiver can the tensioning slider 76*c* move relatively closer to the pushing slider 54*c*, because the still closed door prevents a further forward movement of the pushing slider 54*c*. As a result of the blocking slider 76*c* moving relatively closer, the two sliders 54*c*, 76*c* move from the relative rest position into a relative tensioned position.

As explained in connection with the preceding exemplary embodiments, activation of the arm ram 44*c* at the same time leads to at least partial forced opening of the latch arms 36*c*. The holding-closed action of the latch arms 36*c* thus becomes weaker. From a specific degree of forced opening of the latch arms 36*c* by the arm ram 44*c*, the spring tension that has built up in the opener spring 58*c* is sufficiently great to suddenly push the pushing slider 54*c* away (into the relative rest position) relative to the tensioning slider 76*c* and thereby push the door open. It may be that, at the time the opener spring 58*c* relaxes, the latch arms 36*c* have not been opened sufficiently far by the arm ram 44*c* that the latch head—not shown in FIGS. 8*a* and 8*b*—is able to move out of the grip of the latch arms 36*c*. The spring tension that has built up in the opener spring 58*c* may, however, be sufficiently great to overcome any remaining residual part of the holding-closed action of the latch arms 36*c*.

The distance of the tensioning body 76*c* from the lever axis 72*c* is greater than the distance of the arm ram 44*c* from the lever axis 72*c*. In the example shown, the tensioning body 76*c* is approximately more than twice as far from the lever axis 72*c* as the arm ram 44*c*. By suitably dimensioning the lever lengths of the arm ram 44*c* and of the tensioning body 76*c*, a comparatively large stroke of the tensioning body 76*c* can be achieved with a comparatively small stroke of the arm ram 44*c*. Even when a comparatively short-stroke wax motor is used as the actuator 46*c*, a sufficiently large stroke of the tensioning body 76*c* to tension the opener spring 58*c* sufficiently can then be achieved.

Figure 9A:
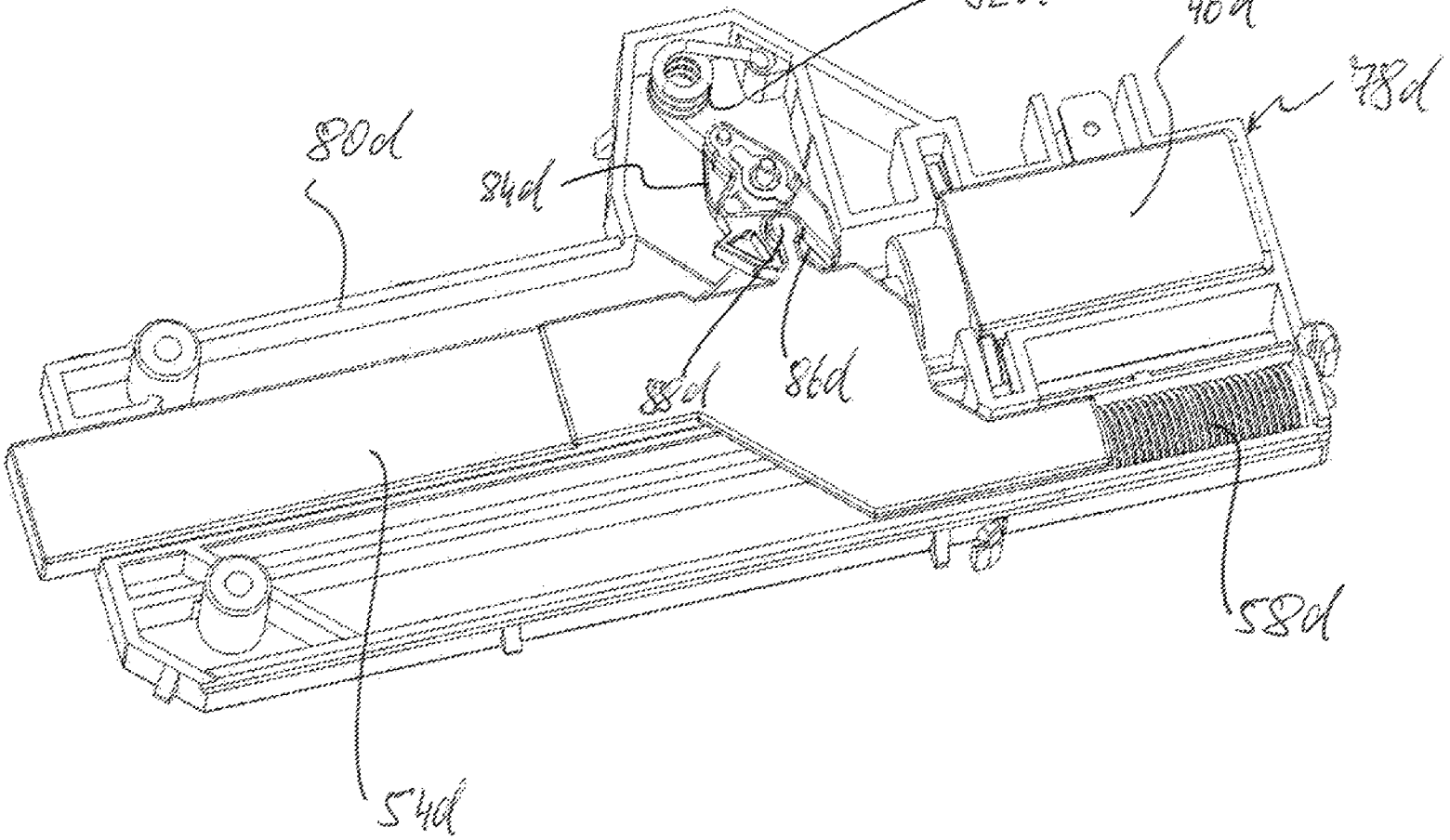
FIG. 9*a* shows, in perspective, a door opener module according to an exemplary embodiment in a deactivated state.
Figure 9B:
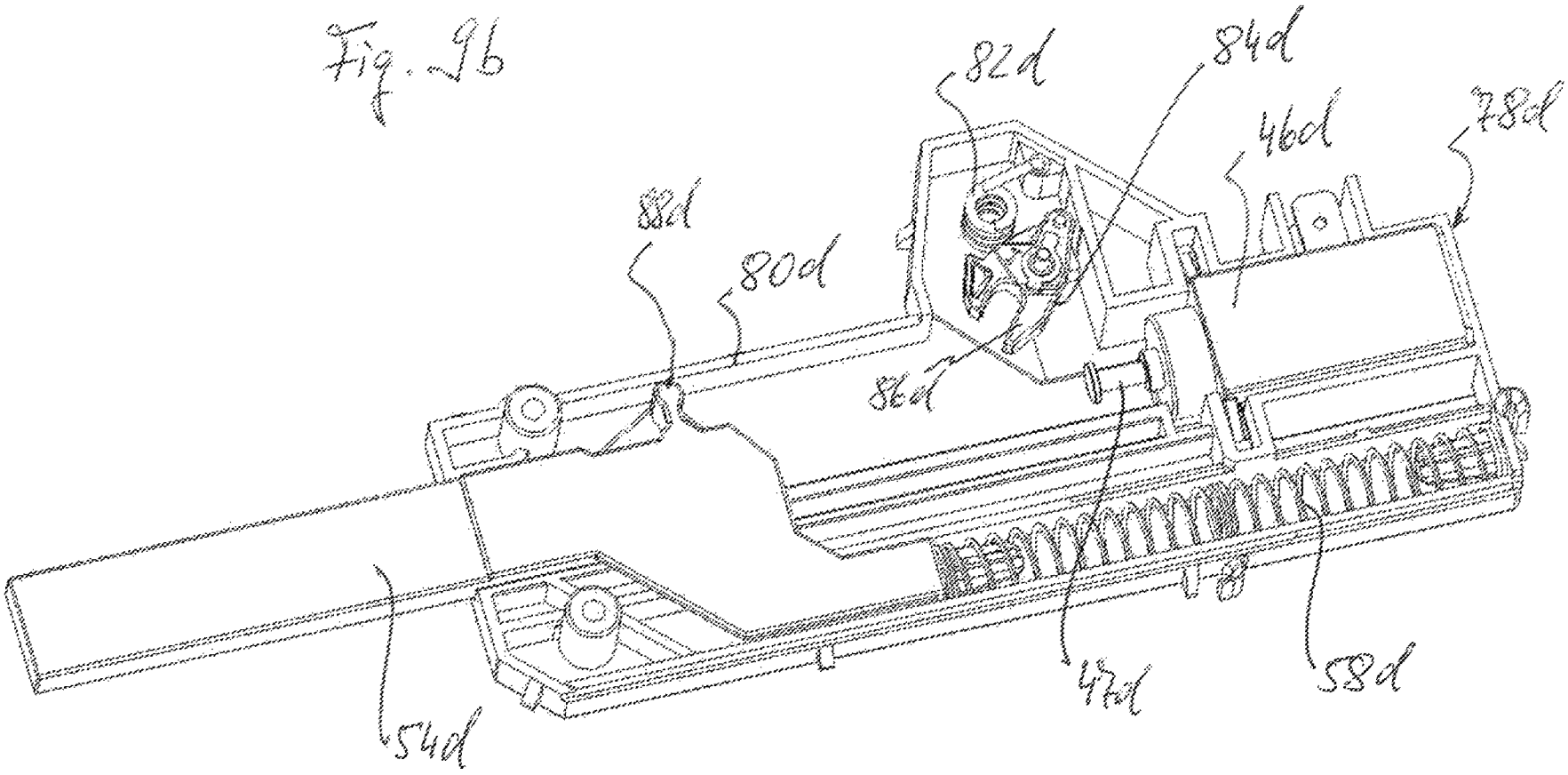
FIG. 9*b* shows, in perspective, the door opener module of FIG. 9*a* after activation.

Finally, reference is made to the exemplary embodiment of FIGS. 9*a* and 9*b*. The door opener module shown therein, generally designated 78*d*, does not have a latching function but offers only a function for automatic door opening. With reference to the dishwasher 10 of FIG. 1, the door opener module 78*d* implements, for example, the functionality of the opener unit 28 but does not offer the functionality of the latch unit 26. A domestic appliance equipped with the door opener module 78*d* nevertheless has a latching function for holding a door of the domestic appliance closed. This latching function can be implemented structurally separately from the door opener module 78*d* in a separate latch module, not shown in detail in the drawings, which, for example, offers the functionality of the latch unit 26 of the dishwasher 10 of FIG. 1. Such a separate latch module can be of conventional configuration, for example corresponding to the latch unit 24 shown in FIG. 2 of DE 10 2012 016 541 A1.

The door opener module 78*d* is a self-contained structural unit with a module housing 80*d* by means of which the door opener module 78*d* can be fastened to a superordinate component, for example the dishwashing container 12 of FIG. 1. All the necessary mechanical and electromechanical components for providing an automatic opening function for the door of a domestic electrical appliance, for example the door 22 of FIG. 1, are accommodated in the module housing 80*d*.

In the deactivated state according to FIG. 9*a*, the pushing slider 54*d* of the door opener module 78*d* is in its retracted position; FIG. 9*b* shows the pushing slider 54*d* in its advanced position after activation of the opening function. In the door opener module 78*d*, the piston 47*d*, which is driven by the actuator 46*d* and serves as the latch opener mechanism within the meaning of the present disclosure, acts mechanically directly on the pushing slider 54*d*. The actuator 46*d* is sufficiently strong to move the pushing slider 54*d*, by driving the piston 47*d* (and assisted by the opener spring 58*d*), contrary to a holding-closed force of the latching function of the domestic appliance from the retracted position according to FIG. 9*a* in the direction towards the advanced position according to FIG. 9*b*. This movement is assisted by the force of the opener spring 58*d*. As soon as the holding-closed action of the latching function is completely overcome, the pushing slider 54*d*—driven by the opener spring 58*d*—suddenly jumps forwards into the advanced position and thereby pushes the door open.

In order to hold the pushing slider 54*d* in its retracted position, the door opener module 78*d* has a rotary member 84*d* which is rotatably mounted on the module housing 80*d* and is spring-biased in a bistable manner by means of a spring element 82*d*, which in the example shown is in the form of a leg spring. The rotary member 84*d* serves as the blocking member within the meaning of the present disclosure and is rotatable between a blocking rotary position shown in FIG. 9*a* and a release rotary position shown in FIG. 9*b*. In both rotary positions, the rotary member 84*d* is biased by the spring element 82*d* against leaving the rotary position in question. Accordingly, starting from the blocking rotary position according to FIG. 9*a*, an external force must be applied in order to transfer the rotary member 84*d* into the release rotary position. The same applies conversely. After a snap point of the spring element 82*d* has been exceeded, the rotary member 84*d* then automatically snaps into the respective new position.

The rotary member 84*d* has a gripping structure 86*d* which, in the blocking rotary position, is in gripping engagement with a suitably configured engagement structure 88*d* of the pushing slider 54*d*. The spring element 82*d* is sufficiently strong to fix the pushing slider 54*d* against leaving the retracted position in the blocking rotary position of the rotary member 84*d*. The force of the opener spring 58*d* is accordingly not sufficient to overcome the blocking action of the rotary member 84*d* alone, that is to say without assistance from the actuator 46*d*, when the rotary member 84*d* is in the blocking rotary position. Only when the actuator 46 is additionally operated can the blocking action of the rotary member 84*d* be overcome and rotation of the rotary member

84*d* into the release rotary position be effected. During this rotation of the rotary member 84*d*, the engagement between the gripping structure 86*d* and the engagement structure 88*d* is released, as is shown in FIG. 9*b*. In the example shown, the gripping structure 86*d* of the rotary member 84*d* is configured in the manner of a gripping mouth delimited by two jaws, and the engagement structure 88*d* is configured in the manner of a head piece which enters this gripping mouth. It will be appreciated that this configuration of the gripping structure 86*d* and of the engagement structure 88*d* is by way of example and can readily be modified.

If the door is then manually closed by the user, the pressure receiver urges the pushing slider 54*d* from the advanced position according to FIG. 9*b* in the direction towards the retracted position according to FIG. 9*a*. The engagement structure 88*d* of the pushing slider 54*d* thereby comes into engagement with the gripping structure 86*d* of the rotary member 84*d* again slightly before the retracted position is reached. As soon as the biasing action of the spring element 82*d* is overcome, which attempts to hold the rotary member 84 in the release rotary position, the rotary member 84*d* snaps suddenly into the blocking rotary position. The pushing slider 54*d* is thereby actively urged by the rotary member 84*d*, driven by the spring element 82*d*, into the retracted position. This active retraction movement over the last portion of the movement path of the pushing slider 54*d* from the advanced position into the retracted position can be used to bring the pushing slider 54*d* out of contact with the pressure receiver. In the deactivated state of the door opener module 78*d* and with the door closed, the pushing slider 54*d* is then at a distance from the pressure receiver.

What is claimed is:

1. A mechanism for a door of a domestic electrical appliance, the mechanism comprising:

a door latch for holding the door closed;

a latch opener mechanism which, when the door is closed, is configured to be transferred from an inactive position into an active position while at least partially overcoming a holding-closed action of the door latch;

an electrically controllable actuator for displacing the latch opener mechanism from the inactive position into the active position;

a movably arranged pusher, which is separate from the latch opener mechanism and is motionally decoupled therefrom, for force transmission, in the sense of opening of the door, in a force transmission path which bypasses the door latch;

a spring drive configured to provide a spring force which acts on the pusher and which, after the holding-closed action of the door latch has been overcome, enables the door to be pushed open by the pusher; and a movably arranged blocking member which is separate from the latch opener mechanism and which, in a blocking position with the door closed, is configured to exert on the pusher a blocking action such that a relaxation of the spring drive that is required for pushing open the door is prevented, wherein the blocking member is linearly movable in a direction substantially perpendicular to a direction of movement of at least one of the latch opener mechanism and the pusher, wherein the blocking member, with the door initially closed, moves, in dependence on a displacement of the latch opener mechanism from the inactive position in the direction towards the active position, into a release position in which the blocking action of the blocking member on the pusher is lifted.

2. The mechanism as claimed in claim 1, wherein the holding-closed action of the door latch is overcome in the active position of the latch opener mechanism.

3. The mechanism as claimed in claim 1, wherein the blocking member is configured to move back into the blocking position as a result of closing the previously pushed-open door.

4. The mechanism as claimed in claim 3, wherein the pusher is configured to move, as a result of the door being pushed open, into an advanced position in which it is within reach of an operator of the domestic appliance, wherein the pusher, in the blocking position of the blocking member, is fixed in a retracted position in which the pusher is out of reach of the operator.

5. The mechanism as claimed in claim 1, wherein the latch opener mechanism is configured to act, when it is displaced with the door closed from the inactive position in the direction towards the active position, in a force-exerting manner on a component of the door latch.

6. The mechanism as claimed in claim 1, wherein the latch opener mechanism is configured to act, when it is displaced with the door closed from the inactive position in the direction towards the active position, in a force-exerting manner on the pusher.

7. The mechanism as claimed in claim 6, wherein the blocking member is configured to be urged from the blocking position into the release position by an exertion of force on the pusher imparted by the latch opener mechanism.

8. The mechanism as claimed in claim 1, wherein the blocking member is or comprises a linearly movable slider component.

9. The mechanism as claimed in claim 1, wherein the blocking member is spring-biased in a bistable manner.

10. The mechanism as claimed in claim 1, comprising a coupling assembly between the latch opener mechanism and the spring drive in order to build up or increase a spring tension of the spring drive in dependence on a displacement of the latch opener mechanism from the inactive position in the direction towards the active position with the door closed.

11. The mechanism as claimed in claim 10, wherein the coupling assembly comprises a tensioning lever which is pivotable about a lever axis and which is movably coupled with the latch opener mechanism at a first point of the tensioning lever that is relatively closer to the lever axis and which acts on the spring drive at a second point of the tensioning lever that is relatively further away from the lever axis.

12. The mechanism as claimed in claim 1, wherein the door latch comprises a closing mechanism which is arranged so as to be displaceable between a closed state and an open state and which in the closed state retains a counter-body for holding the door closed, which on closing of the door comes into closing engagement with the closing mechanism, and in the open state releases the counter-body for opening of the door, wherein the door latch further comprises a closing spring assembly which provides a resistance to a displacement of the closing mechanism from the closed state in the direction towards the open state, and wherein the latch opener mechanism is configured to urge the closing mechanism, by physical contact, from the closed state against the resistance of the closing spring assembly in the direction towards the open state.

13. The mechanism as claimed in claim 12, wherein the displacement stroke of the latch opener mechanism between the inactive position and the active position is sufficient to effectuate a transfer of the closing mechanism from the closed state into the open state when the door is closed.

14. The mechanism as claimed in claim 1, wherein the actuator comprises one of a wax motor and an electric motor.

* * * * *